US011819813B2

(12) United States Patent
Schöb

(10) Patent No.: US 11,819,813 B2
(45) **Date of Patent: *Nov. 21, 2023**

(54) MIXING APPARATUS WITH A CONTACTLESSLY MAGNETICALLY DRIVABLE ROTOR

(71) Applicant: Levitronix GmbH, Zürich (CH)

(72) Inventor: Reto Schöb, Rudolfstetten (CH)

(73) Assignee: LEVITRONIX GMBH, Zürich (CH)

( * ) Notice: Subject to any disclaimer, the term of this patent is extended or adjusted under 35 U.S.C. 154(b) by 0 days.

This patent is subject to a terminal disclaimer.

(21) Appl. No.: 15/581,880

(22) Filed: Apr. 28, 2017

(65) Prior Publication Data

US 2017/0312713 A1 Nov. 2, 2017

(30) Foreign Application Priority Data

May 2, 2016 (EP) ..... 16167908
Feb. 6, 2017 (EP) ..... 17154806

(51) Int. Cl.

| | |
|---|---|
| ***B01F 33/453*** | (2022.01) |
| ***B01F 33/452*** | (2022.01) |
| ***B01F 35/60*** | (2022.01) |
| ***B01F 35/513*** | (2022.01) |
| ***B01F 35/53*** | (2022.01) |
| ***B01F 35/30*** | (2022.01) |
| ***B01F 101/22*** | (2022.01) |
| ***B01F 101/44*** | (2022.01) |

(52) U.S. Cl.

CPC ..... *B01F 33/4531* (2022.01); *B01F 33/452* (2022.01); *B01F 33/4532* (2022.01); *B01F 35/513* (2022.01); *B01F 35/5312* (2022.01); *B01F 35/60* (2022.01); *B01F 2035/352* (2022.01); *B01F 2101/22* (2022.01); *B01F 2101/44* (2022.01)

(58) Field of Classification Search

CPC ..... B01F 13/0827–089; B01F 13/0836; B01F 13/0845; B01F 13/0854; B01F 13/0863; B01F 13/08; B01F 13/0872; B01F 13/0881; B01F 13/0818; B01F 33/4531; B01F 33/452; B01F 33/4532; B01F 35/513; B01F 35/5312; B01F 35/60; B01F 2035/352; B01F 2101/22; B01F 2101/44

USPC ..... 416/3; 366/273–274

See application file for complete search history.

(56) References Cited

U.S. PATENT DOCUMENTS 1,242,493 A * 10/1917 Stringham ..... B01F 33/4534 310/67 R
2,711,306 A * 6/1955 Levi ..... B01F 13/0827 366/273
2,958,517 A * 11/1960 De Long ..... B01F 33/4533 422/566
3,572,651 A * 3/1971 Harker ..... B01F 33/4534 366/273
3,622,129 A * 11/1971 Mazowski ..... B01F 33/453 366/274
3,649,465 A * 3/1972 Scharf ..... B01F 33/453 366/244
3,958,465 A * 5/1976 Hiersig ..... F16H 1/26 475/1
4,199,265 A * 4/1980 Sanderson ..... B01F 13/0818 366/274
4,483,623 A * 11/1984 Eaton ..... B01F 33/453 366/273
4,512,666 A * 4/1985 O'Connell ..... B01F 33/453 366/249
4,752,138 A * 6/1988 Rufer ..... B01F 13/0818 366/273
4,759,635 A * 7/1988 MacMichael ..... B01F 33/452 366/247
5,078,504 A * 1/1992 Landa ..... B01F 3/0819 366/118
5,147,612 A * 9/1992 Raal ..... B01F 3/022 137/88

(Continued)

FOREIGN PATENT DOCUMENTS

DE 3500573 A1 7/1986
DE 102006014471 A1 * 10/2007 ..... A47G 19/2205

(Continued)

OTHER PUBLICATIONS

Machine traslation of DE 102006014471 A1—Description only—Oct. 2007 (Year: 2007).*

(Continued)

*Primary Examiner* — Charles Cooley

(74) *Attorney, Agent, or Firm* — GLOBAL IP COUNSELORS, LLP

(57) ABSTRACT

A mixing apparatus for mixing or stirring substances includes a mixing tank for receiving the substances, a rotor arranged in the mixing tank with which a vane for mixing or stirring the substances can be driven to rotate about an axial direction, and a stator arranged outside the mixing tank and with which the rotor can be driven contactlessly magnetically to rotate about the axial direction in the operating state and is supported magnetically with respect to the stator. A bar extends in the axial direction and is rotationally fixed to the rotor, and a limiting element fixed with respect to the mixing tank cooperates with the bar, with the limiting element being configured such that the bar rotates with respect to the limiting element and with a tilt of the rotor being limited by a physical contact between the bar and the limiting element.

17 Claims, 10 Drawing Sheets

(56) References Cited

U.S. PATENT DOCUMENTS

| | | | | | |
|---|---|---|---|---|---|
| 5,167,449 | A * | 12/1992 | Killough | B01F 27/054 | 403/379.5 |
| 6,100,618 | A * | 8/2000 | Schoeb | F04D 29/048 | 310/90.5 |
| 6,733,171 | B2 * | 5/2004 | Schob | B01F 13/0836 | 366/273 |
| 7,153,021 | B2 * | 12/2006 | Goodwin | B01F 13/0818 | 366/273 |
| 7,185,648 | B1 * | 3/2007 | Rand | A61M 15/009 | 128/200.23 |
| 7,832,922 | B2 * | 11/2010 | Schoeb | B01F 7/00925 | 366/273 |
| 9,045,722 | B2 * | 6/2015 | Reif | B01F 7/1695 | |
| 9,801,500 | B2 * | 10/2017 | Ven Der Woning | A47J 43/1093 | |
| 10,876,533 | B2 * | 12/2020 | Luxford | F04D 29/0473 | |
| 11,619,236 | B2 * | 4/2023 | Schöb | F04D 29/426 | |
| 2003/0008389 | A1 * | 1/2003 | Carll | B01F 11/0082 | 435/302.1 |
| 2003/0053371 | A1 * | 3/2003 | Schoeb | B01F 33/4533 | 366/273 |
| 2007/0053238 | A1 * | 3/2007 | Kocienski | B01F 7/186 | 366/273 |
| 2008/0131957 | A1 | 6/2008 | Ryan et al. | | |
| 2009/0142827 | A1 * | 6/2009 | Schoeb | B01F 7/00716 | 435/302.1 |
| 2011/0002794 | A1 * | 1/2011 | Haefliger | F04D 13/0633 | 417/53 |
| 2011/0013474 | A1 | 1/2011 | Ludwig et al. | | |
| 2013/0022481 | A1 * | 1/2013 | Schob | F04D 13/064 | 417/420 |
| 2016/0290405 | A1 * | 10/2016 | Kojima | F16C 33/105 | |
| 2016/0333300 | A1 * | 11/2016 | Kronenberg | B01F 15/0085 | |
| 2017/0312712 | A1 * | 11/2017 | Schob | B01F 13/0836 | |
| 2017/0312713 | A1 * | 11/2017 | Schob | B01F 13/0836 | |
| 2019/0013747 | A1 * | 1/2019 | Barletta | F04D 13/064 | |
| 2021/0079922 | A1 * | 3/2021 | Schmid | F04D 13/06 | |
| 2021/0254623 | A1 * | 8/2021 | Schöb | H02K 7/14 | |

FOREIGN PATENT DOCUMENTS

| | | | | | |
|---|---|---|---|---|---|
| EP | 1748201 | A2 | | 1/2007 | |
| EP | 2065085 | A | | 6/2009 | |
| GB | 1413835 | A | * | 11/1975 | F04D 13/0646 |
| GB | 2565592 | | * | 2/2019 | |
| JO | S61212278 | A | | 9/1986 | |
| JP | 56045752 | A | * | 4/1981 | B01F 13/0827 |
| JP | S5952519 | A | | 3/1984 | |
| JP | 61212275 | A | * | 9/1986 | B01F 13/0818 |
| JP | 63031528 | A | * | 2/1988 | B01F 13/0827 |
| JP | H01180227 | A | | 7/1989 | |
| WO | 2017016640 | A1 | | 2/2017 | |

OTHER PUBLICATIONS

Extended European Search Report dated Nov. 24, 2016 in corresponding European Patent Application No. 16167908.9, filed May 2, 2016 (with English Translation of Categories of Cited Documents).

Extended European Search Report dated Oct. 6, 2017 in corresponding European Patent Application No. 17154806.8, filed Feb. 6, 2017 (with English Translation of Categories of Cited Documents).

* cited by examiner

MIXING APPARATUS WITH A CONTACTLESSLY MAGNETICALLY DRIVABLE ROTOR

CROSS-REFERENCE TO RELATED APPLICATION

This application claims priority to European Application No. 16167908.9, filed May 2, 2016 and European Application No. 17154806.8, filed Feb. 6, 2017, the contents of which are hereby incorporated herein by reference.

BACKGROUND

Field of the Invention

The invention relates to a mixing apparatus for mixing or stirring substances as well as to a single-use apparatus for a mixing apparatus.

Background of the Invention

Mixing apparatus for mixing or stirring substances, for example two liquids or one liquid with a powder or liquids or suspensions with gases, are used in many technical fields. In a number of applications, the cleanliness of the mixing tank in which the mixing takes place and of the components located therein has a very great significance in this respect. The pharmaceutical industry and the biotechnological industry can be named as examples here. Solutions and suspensions are frequently produced here which require a careful intermixing of the substances.

In the pharmaceutical industry, for example in the production of pharmaceutically active substances, very high demands are made on cleanliness; the components which come into contact with the substances often even have to be sterile. Similar demands also result in biotechnology, for example in the manufacture, treatment or cultivation of biological substances, cells or microorganisms, where an extremely high degree of cleanliness has to be ensured in order not to endanger the usability of the product produced. Bioreactors can be named as a further example here in which, for example, biological substitutes for tissue or special cells or microorganisms are cultivated. Mixing apparatus are also required here in order, for example, to ensure a continuous intermixing of the nutrient fluid or to ensure its continuous circulation in the mixing tank. A high purity has to be ensured in this respect to protect substances or the produced products from contamination.

To be able to satisfy the purity demands for the process in the best possible manner, it is endeavored to keep the number of components of a mixing apparatus which come into contact with the respective substances as low as possible. Electromagnetically operated mixing apparatus are known for this purpose in which a rotor, which typically comprises or drives an impeller, is arranged in the mixing tank. A stator is then provided outside the mixing tank which drives the rotor contactlessly through the wall of the mixing tank and supports it magnetically without contact in a desired position by magnetic or electromagnetic fields. This "contactless" concept in particular also has the advantage that no mechanical bearings or leadthroughs into the mixing tank are required which may form a cause of impurities or contaminants.

A particularly efficient apparatus of this type with which substances are circulated or blended in a bioreactor is disclosed within the framework of EP B 2 065 085. The stator and the rotor arranged in the mixing tank form a bearingless motor here. The term bearingless motor in this respect means an electromagnetic rotary drive in which the rotor is supported completely magnetically with respect to the stator, with no separate magnetic bearings being provided. For this purpose, the stator is configured as a bearing and drive stator; it is therefore both the stator of the electric drive and the stator of the magnetic support. A rotating magnetic field can be produced using the electrical windings of the stator which, on the one hand, exerts a torque onto the rotor which effects its rotation and which, on the other hand, exerts a shear force, which can be set as desired, onto the rotor so that the rotor's radial position can be controlled or regulated actively.

The rotor of this mixing apparatus represents an integral rotor because it is both the rotor of the electromagnetic drive and the rotor of the mixer. In addition to the contactless magnetic support, the bearingless motor furthermore provides the advantage of a very compact and space-saving design.

The number of components coming into contact with the substances can be greatly reduced using such contactlessly magnetically supported mixers. The purifying or sterilizing of these components still represents a very great effort in time, material and cost for particularly sensitive applications. A change is therefore frequently being made—as is also disclosed in the already cited EP B 2 065 085—to design the components coming into contact with the substances as single-use parts for single use. Such a mixing apparatus is then composed of a single-use apparatus and a reusable apparatus. In this respect, the single-use apparatus comprises those components which are intended for single use, that is, for example, the mixing tank with the rotor, and the reusable apparatus comprises those components which are used permanently, that is multiple times, for example the stator.

In the configuration as a single-use part, the mixing tank is frequently designed as a flexible plastic pouch with a rotor contained therein. These pouches are frequently already sterilized during manufacture or after the packaging and storing and are supplied to the customer in sterile form in the packaging.

SUMMARY

It is an important criterion for the manufacture or design of single-use parts for single use that they can be assembled in as easy a manner as possible with the reusable apparatus or its components. It is desirable that this assembly can take place with as little effort as possible, with little work, fast and preferably without tools.

Another aspect is that these single-use parts can be manufactured as economically and inexpensively as possible. In this respect value is in particular also placed on reasonably priced simple starting materials such as commercial plastics. An environmentally aware handling and a responsible use of the available resources are also major aspects in the design of disposable parts.

In mixing apparatus having a magnetically supported rotor, problems can result, both in the design as a single-use part and in the design for multiple use, from the fact that the magnetic support cannot be exposed to a load of any desired amount. This in particular also applies to such designs in which at least one degree of freedom of the rotor is only passively magnetically stabilized by reluctance forces, that is it cannot be actively controlled or regulated. If the forces or torques relating to this degree of freedom become too great on the rotor, a reliable magnetic support of the rotor is thus no longer ensured. An example for this is tilts of the rotor with respect to the axial direction fixed by the desired axis of rotation. If the tilt moments acting on the rotor in the operating state become too large, the reluctance forces stabilizing the rotor are no longer sufficient to generate sufficiently large restoring torques that can reverse the tilt of the rotor.

Starting from this prior art, it is therefore an object of the invention to provide a mixing apparatus for mixing or stirring substances that comprises a magnetically supported rotor, with the rotor being stabilized better against tilts. The mixing apparatus should in particular also be able to be designed such that it comprises a single-use apparatus for single use and a reusable apparatus for multiple use. A single-use apparatus for such a mixing apparatus should furthermore be provided by the invention.

The subjects of the invention satisfying this object are characterized by the features described herein.

In accordance with the invention, a mixing apparatus is therefore provided for mixing or stirring substances, having a mixing tank for receiving the substances to be mixed or to be stirred; having a rotor arranged in the mixing tank by which at least one vane for mixing or stirring the substances can be driven to rotate about an axial direction; and having a stator that is arranged outside the mixing tank and by which the rotor can be driven contactlessly magnetically to rotate about the axial direction in the operating state and can be supported magnetically with respect to the stator, with a bar being provided that extends in the axial direction and that is rotationally fixedly connected to the rotor, as well as a mechanical limiting element that is fixed with respect to the mixing tank and that cooperates with the bar, with the limiting element being designed and arranged such that the bar can rotate with respect to the limiting element and with a tilt of the rotor at least being limited by a physical contact between the bar and the limiting element.

It is ensured by the provision of the bar and of the limiting element that the magnetically supported rotor is stabilized better and more reliably against tilts with respect to the axial direction because its maximum possible tilt is at least mechanically limited. Such tilts of the rotor with respect to the axial direction in which the plane in which the rotor rotates is no longer perpendicular to the axial direction represent two degrees of freedom of the movement of the rotor that are both bounded by the bounding element in cooperation with the bar.

The bar can in this respect be produced in one piece and have a fixed, i.e. non-variable, length in the axial direction. It is, however, alternatively also possible that the bar comprises a plurality of parts arranged concentrically in one another, for example tubes that are displaceable relative to one another in the axial direction such that the bar can, like a telescopic antenna, be extended in its length or can be pushed together to the length of the individual tubes in a known manner.

In a preferred embodiment, the stator is designed as a bearing and drive stator by which the rotor can be contactlessly magnetically driven in the operating state and is contactlessly magnetically supportable at least radially with respect to the stator. That is, at least the position of the rotor in the radial plane can be controlled by an active magnetic support. This embodiment makes possible a particularly inexpensive and also space-saving, compact design because the stator is not only configured as a drive stator, but is also simultaneously the stator for the magnetic support of the rotor. Such a design can, for example, take place in accordance with the principle of a bearingless motor in which the rotor is actively magnetically controllable with respect to its three degrees of freedom, namely the rotation about the axial direction and its position in the radial planes perpendicular to the axial direction.

It is additionally advantageous if the rotor is passively magnetically stabilized with respect to the axial direction in the operating state and is preferably additionally passively magnetically stabilized against tilts with respect to the axial direction. Such a design is also possible in accordance with the principle of a bearingless motor. In addition to the three actively magnetically controllable degrees of freedom, the three remaining degrees of freedom, namely the position of the rotor in the axial direction and the two degrees of freedom of the tilt, are then passively magnetically stabilized, that is are not controllable, by reluctance forces.

In accordance with a first preferred embodiment, the limiting element is configured as a tilt limitation such that the bar rotates free of contact with respect to the tilt limitation with a non-tilted rotor in the operating state and such that a tilt of the rotor is limited by a physical contact between the bar and the tilt limitation.

In this first preferred embodiment, it is a material aspect that the limiting element and the bar only contact one another in the operating state when the tilt of the rotor becomes too large or too great. If the rotor is not tilted or is only slightly tilted, the bar and the limiting element do not contact one another, i.e. in this state, the magnetic support of the rotor is not supported by the tilt limitation since it does not exert any forces onto the bar or onto the rotor that contribute to the support of the rotor. The bar rotates contactlessly with respect to the tilt limitation and does not contact it. Only when the tilt of the rotor becomes too large does the bar contact the tilt limitation, whereby a further increase in the tilt of the rotor is efficiently avoided. The tilt limitation therefore does not represent a fully-fledged bearing for the rotor, but rather limits its maximum possible tilt.

In this first embodiment, the bar and the tilt limitation are preferably configured such that, on a tilt of the rotor, the bar comes into contact with the limiting element before the rotor comes into physical contact with a wall surrounding it. I.e. the spacing or the clearance between the bar and the limiting element configured as a tilt limitation is dimensioned such that the bar comes into contact with the limiting element and the thus inhibits the further tilting of the rotor before the rotor can contact the wall surrounding it.

In accordance with a second preferred embodiment, the limiting element is configured as a mechanical bearing for the bar, preferably as a mechanical radial bearing.

In this second preferred embodiment, the limiting element is therefore configured as a fully-fledged mechanical bearing that supports the bar rotationally fixedly connected to the rotor. The tilt of the rotor can also at least be limited in the operating state by this configuration of the limiting element as a mechanical bearing and in particular as a mechanical radial bearing. Unlike the first preferred embodiment, the bar is in this respect typically also in contact with the limiting element in the operating state when the rotor is not tilted, such as is known from mechanical bearings.

In principle, all embodiments of mechanical bearings known per se are suitable for the configuration of the limiting element as a mechanical bearing, in particular all the radial mechanical bearings known per se, for it is preferred if the mechanical bearing is configured as a radial bearing and does not contribute to the axial support of the rotor. The mechanical bearing is in particular preferably configured as a rolling bearing, for example as a ball bearing, or as a slide bearing or as a fluid-lubricated bearing or as a hydrodynamic bearing. In the embodiment as a fluid-lubricated or hydrodynamic bearing, it is preferred in this respect that a fluid present in the mixing apparatus is used for the lubrication of the bearing in the operating state.

It is a further preferred measure in the configuration of the limiting element as a mechanical bearing if the mechanical bearing is configured as a pendulum bearing that can absorb tilts of the bar. Such pendulum bearings per se are sufficiently known from the prior art. They have the property that, in addition to the radial bearing forces, they can also absorb tilting effects that are transmitted to the mechanical bearing via the bar on a tilt of the rotor.

The pendulum bearing can, for example, be configured in a manner known per se as a pendulum ball bearing—with or without a shaft between the bearing bodies—or as a pendulum roller bearing or as pendulum slide bearing or as a spherical slide bearing or as a joint slide bearing.

The following preferred measures or configurations generally relate to the limiting element, that is both to the first embodiment as a tilt limitation and to the second embodiment as a mechanical bearing.

A preferred measure comprises the limitation element being arranged inwardly disposed at one of the two axial limiting surfaces of the mixing tank. This represents a particularly simple embodiment from a design aspect.

In accordance with a preferred embodiment, the limiting element is arranged disposed opposite the rotor such that the bar extends substantially through the total mixing tank with respect to the axial direction. For example, the rotor is arranged in the region of the base of the mixing tank in the stator for this purpose, whereas the limiting element is arranged at the oppositely disposed inner side or inner wall of the mixing tank, that is at its upper limiting surface. The bar then extends from the center of the rotor in the axial direction through the total mixing tank and is then received by the limiting element.

A preferred measure comprises the bar being secured against a separation from the limiting element. After assembling the mixing tank, it is namely thereby prevented that the bar loses its active connection to the limiting element in an unwanted manner, whereby the operating safety of the mixing tank is increased.

An advantageous possibility of securing the bar against a separation from the limiting element comprises the bar extending through the limiting element in an axial direction. The limiting element has a circular opening for this purpose, for example, that is continuous in the axial direction and through which the bar is pushed on the assembly of the mixing apparatus such that the limiting element subsequently completely surrounds the bar.

Another advantage measure of securing the bar against a separation from the limiting element comprises the bar having a terminating element at its end remote from the rotor and is designed for reception by the limiting element.

It is preferred in this respect if the terminating element can be introduced into the limiting element via a snap-in connection. For this purpose, the terminating element, for example, has a diameter that is larger than the diameter of the rest of the bar. The terminating element can then be introduced into the limiting element through an opening thereof, with the opening having a diameter that is smaller than the diameter of the terminating element and is larger than the diameter of the rest of the bar. After the snapping in of the terminating element, it is thereby ensured that the bar is free in this opening, i.e. can rotate contactlessly when the rotor is not tilted if the limiting element is configured as a tilt limitation. In the configuration of the limiting element as a mechanical bearing, the snapping in prevents the bar from separating from the mechanical bearing during operation.

It is in particular preferred for the implementation of the snap-in connection if the terminating element is designed in spherical form or in frustoconical form because then the bar can roll off the limiting element on a contact therewith.

Another advantageous measure to secure the bar against a separation from the limiting element comprises the limiting element having a pin that extends in the axial direction and that can be introduced into the end of the bar. In this respect, the pen and the end of the bar receiving it can be designed such that the pin is introduced into the bar via a snap-in connection.

To implement a particularly good intermixing of the substances in the mixing tank or to implement an efficient stirring of the substances, it is advantageous if a plurality of vanes for mixing or stirring the substances are provided at the bar.

It is in particular advantageous with respect to a design as a single-use part if the limiting element is designed as stable in shape and is manufactured from plastic. This allows a particularly simple and inexpensive manufacture. It is also preferred for the same reason if the bar and all the vanes are manufactured from a plastic.

In a particularly preferred embodiment, the mixing apparatus comprises components that are designed as single-use parts for single use. For this purpose, the mixing apparatus has a single-use apparatus that is designed for single use and has a reusable apparatus that is designed for multiple use, with the single-use apparatus comprising the mixing tank, the rotor, all the vanes, the bar and the limiting element, with the mixing tank being designed as a flexible mixing tank and being manufactured from a plastic, and with the reusable apparatus comprising the stator as well as a support tank for receiving the mixing tank.

A single-use apparatus is furthermore proposed by the invention for a mixing apparatus in accordance with the invention, which mixing apparatus comprises the reusable apparatus that is designed for multiple use, with the single-use apparatus being designed for single use and comprising the flexible mixing tank for receiving the substances to be mixed or to be stirred and being manufactured from a plastic, and comprising the rotor that is arranged in the mixing tank and by which the at least one vane for mixing or stirring the substances can be driven to rotate about the axial direction, and comprising the bar that extends in the axial direction in the operating state and that is rotationally fixedly connected to the rotor, and comprising the limiting element that is fixed with respect to the mixing tank and that cooperates with the bar, with the limiting element being designed and arranged such that the bar can rotate with respect to the limiting element in the operating state and a tilt of the rotor is at least limited by a physical contact between the bar and the limiting element, with furthermore the single-use apparatus being designed for cooperation with the reusable apparatus and being insertable into the support tank of the reusable apparatus, with the rotor being drivable about the axial direction by the stator of the reusable apparatus contactlessly through a magnetic rotationally field and being magnetically supportable with respect to the stator.

Further advantageous measures and embodiments of the invention result from the dependent claims.

BRIEF DESCRIPTION OF THE DRAWINGS

The invention will be explained in more detail hereinafter with reference to the drawings.

DETAILED DESCRIPTION OF THE EMBODIMENTS

Figure 1:
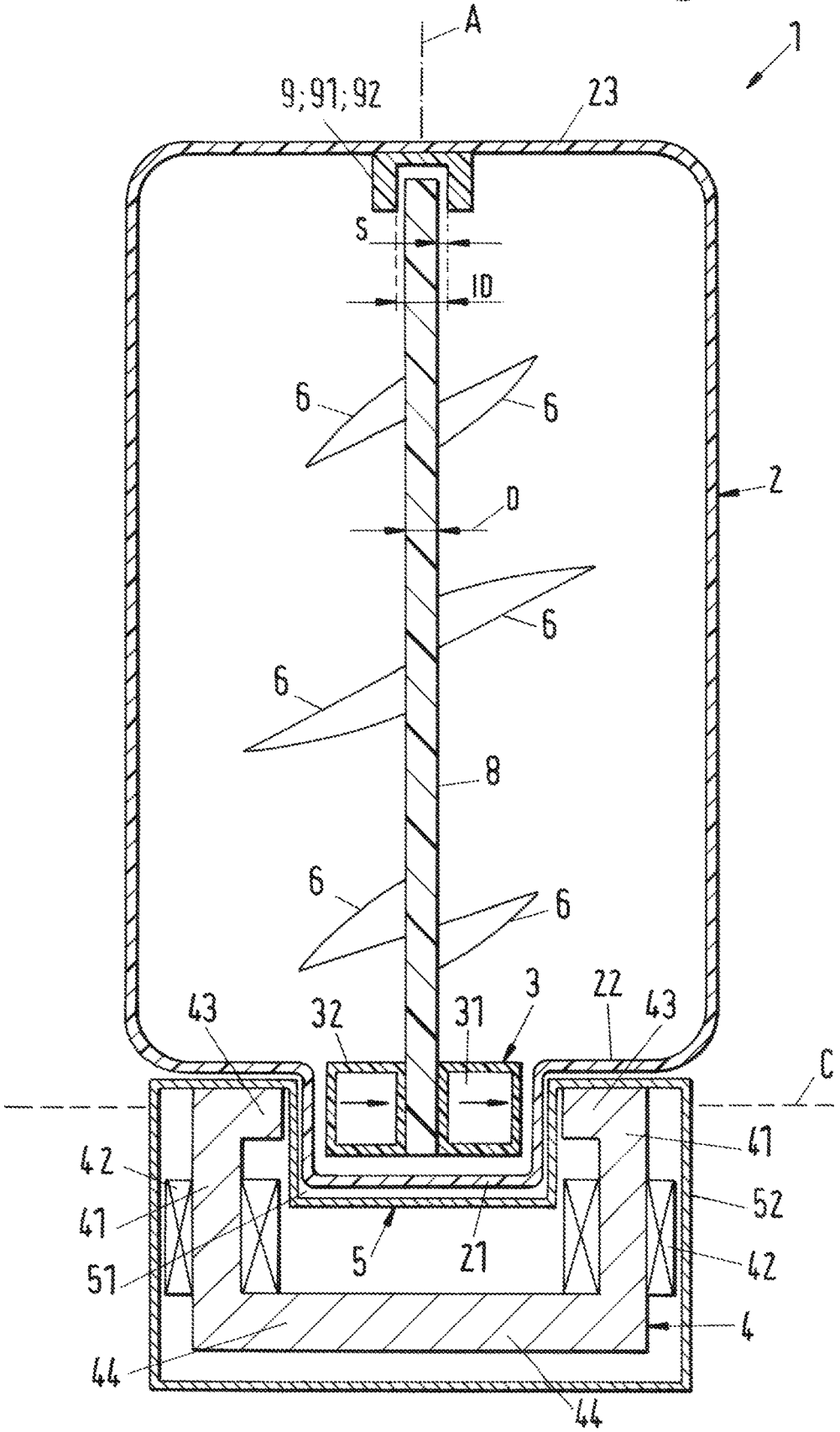
FIG. 1 is a sectional representation of a first embodiment of a mixing apparatus in accordance with the invention.

FIG. 1 shows in a longitudinal sectional representation a first embodiment of a mixing apparatus in accordance with the invention which is designated as a whole by the reference numeral 1. Such mixing apparatus 1 can in particular be used in the pharmaceutical industry and in the biotechnological industry. The mixing apparatus in accordance with the invention is also specifically suitable for such applications in which a very high degree of purity or sterility of those components is key which come into contact with the substances to be mixed. The mixing apparatus 1 in accordance with the invention can also be designed as a bioreactor or as a fermentor. It is understood, however, that the invention is not restricted to those embodiments, but rather relates very generally to mixing apparatus by which media or substances can be mixed or stirred. These substances can in particular be fluids or solids, preferably powders. The mixing apparatus 1 in accordance with the invention is suitable for mixing or stirring liquids among one another and/or for mixing of at least one liquid with a powder or other solid and/or for mixing gases with liquids and/or solids.

In the first embodiment shown in FIG. 1, the mixing apparatus 1 comprises a mixing tank 2 for receiving the substances to be mixed or to be stirred that is stable in shape and that is preferably manufactured from a plastic. Examples for suitable plastics will be named further below. The mixing tank 2 can have a plurality of inlets and outlets for liquid, gaseous or solid substances or for the reception of probes or measuring sensors that are not shown in FIG. 1 for reasons of better clarity.

The mixing tank 2 has two axial limiting surfaces, namely a base 22 (at the bottom in the representation in FIG. 1) and a top 23 (at the top in the representation in FIG. 1).

A disk-shaped or ring-shaped rotor 3 is arranged in the mixing tank 2, at the base 22 thereof, and a plurality of vanes 6 can be driven by it to rotate about an axial direction A and mix or stir the substances in the mixing tank 2. A stator 4 having a plurality of coil cores 41 that carry the coils or windings 42 is provided outside the mixing tank and the rotor 3 can be contactlessly magnetically driven thereby in the operating state. The stator 4 is preferably designed as a bearing and drive stator by which the rotor 3 can be contactlessly magnetically driven in the operating state and can be contactlessly magnetically supported with respect to the stator 4. The stator 4 and the rotor 3 thus form an electromagnetic rotary drive that is preferably designed in accordance with the principle of a bearingless motor.

In a bearingless motor, the rotor 3 is contactlessly magnetically drivable and is contactlessly magnetically supportable with respect to the stator 4. For this purpose, the stator 4 is designed as a bearing and drive stator by which the rotor 3 can be driven contactlessly magnetically about a desired axis of rotation in the operating state—that is it can be set into rotation—and can be supported contactlessly magnetically with respect to the stator 4. That axis is called the desired axis of rotation about which the rotor 3 rotates in the operating state when the rotor 3 is in a centered and non-tilted position with respect to the stator 4. This desired axis of rotation defines the axial direction A, i.e. the axial direction A is the direction of the desired axis of rotation. The desired axis of rotation fixing the axial direction A typically coincides with the central axis of the stator 4. A direction perpendicular to the axial direction is called a radial direction.

The bearingless motor has in the meantime become sufficiently well-known to the skilled person so that a detailed description of its function is no longer necessary. The term bearingless motor means that the rotor 3 is supported completely magnetically, with no separate magnetic bearings being provided. The stator 4 is configured for this purpose as a bearing and drive stator; it is therefore both the stator of the electric drive and the stator of the magnetic support. The stator 4 in this respect comprises the windings 42 by which a magnetic rotational field can be generated which, on the one hand, exerts a torque on the rotor 3 which effects its rotation and which, on the other hand, exerts a shear force on the rotor 3 which can be set as desired so that its radial position—that is its position in the radial plane perpendicular to the axial direction A. can be actively controlled or regulated. At least three degrees of freedom of the rotor 3 can thus be actively regulated. The rotor 3 is at least passively magnetically stabilized, that is cannot be controlled, by reluctance forces with respect to its axial deflection in the axial direction A. The rotor 3 can also likewise be stabilized—depending on the embodiment—passively magnetically with respect to the remaining two degrees of freedom, namely tilts with respect to the radial plane perpendicular to the desired axis of rotation.

With a bearingless motor, unlike with classical magnetic bearings, the magnetic support and the drive of the motor is implemented via electromagnetic rotational fields whose sum, on the one hand, generates a drive torque on the rotor 3 as well as a transverse force that can be set as desired and with which the radial position of the rotor 3 can be regulated. These rotational fields can be generated either separately—that is using different coils—or the rotational fields can be generated by superposition by calculation of the required currents or voltages and then with the aid of a single coil system.

To position the rotor 3 in the mixing tank 2, the mixing tank 2 has at its base 22 a substantially cylindrical bucket 21 that extends outwardly as a bulge with respect to the mixing tank 2 and is arranged at the center of the base 22. The cylindrical bucket 21 is preferably stable in shape and produced from a plastic. The rotor 3 is arranged in the bucket 21.

The stator 4 is arranged such that it completely surrounds the bucket 21 in the peripheral direction so that the rotor 3 is arranged centrally between the stator poles 43 formed by the coil cores 41.

The rotor 3 comprises a magnetically effective core 31 that interacts with the stator 4 via magnetic fields to magnetically drive and support the rotor 3. In the present embodiment, the magnetically active core 31 of the rotor 3 is an annular permanent magnet whose magnetization is indicated in FIG. 1 by the two arrows without reference numerals. The magnetically effective core 31 includes a jacket 32 that comprises plastic.

In the following the magnetic center plane of the magnetically effective core 31 of the rotor 3 is called the magnetic rotor plane C. It is that plane perpendicular to the axial direction A in which the rotor 3 or the magnetically effective core 31 of the rotor 3 is supported in the operating state when the rotor 3 is not tilted. As a rule, the magnetic rotor plane C is the geometrical center plane of the magnetically effective core 31 of the rotor 3 that is disposed perpendicular to the axial direction A. That plane in which the rotor 3 is supported in the operating state is also called the radial plane. The radial plane defines the x-y plane of a Cartesian coordinate system whose z axis extends in the axial direction. If the rotor 3 is therefore not tilted, the radial plane coincides with the magnetic rotor plane C.

The bucket 21 has a depth in the axial direction that is somewhat larger than the extent of the magnetically effective core 31 of the rotor 3 in the axial direction A. The rotor 3 can thus be raised from the base of the bucket 21 by the magnetic forces on the activation of the electromagnetic rotary drive and can be brought into a centered position between the stator poles 43 where the rotor 3 can then rotate contactlessly with respect to the bucket 21.

The stator 4 is arranged in a substantially cylindrical separating can 5 that has a centrally arranged cut-out 51 that is likewise cylindrical at its upper side in accordance with the representation and that is dimensioned such that it can receive the bucket 21. In the assembled state, the bucket 21 of the mixing tank 2 is arranged coaxially with the separating can 5 or with the recess 51. The dimensions of the separating can 5 and of the bucket 21 are adapted to one another in this respect such that the separating can 5 tightly surrounds the bucket 21 in the assembled state and its jacket surface contacts the jacket surface of the bucket 21.

The separating can 5 is an integral component of a stator housing 52 or is fixedly connected to the stator housing 52 that receives the stator 4. The stator 4 in this embodiment is molded by a thermally conductive compound in the separating can 52 and is thus fixed in the separating can 52.

In the embodiment described here, the rotary drive formed by the stator 4 and the rotor 3 is designed as a so-called temple motor. What is characteristic in a design as a temple motor is that the stator 4 comprises a plurality of separate coil cores 41 of which each comprises a bar-shaped longitudinal limb that extends from a first end in the axial direction A up to a second end, with all the first ends—they are the lower ends in accordance with the representation in FIG. 1—being connected to one another by a reflux 44. In this respect, the reflux 44 comprises a plurality of segments of which each connects the respective first end of a coil core 41 to the first end of the adjacent coil core 41. In this respect, the individual coil cores 41 are preferably arranged such that they surround the rotor 3 in a circular manner and are arranged equidistant on this circle. In operation, the rotor 3 is contactlessly magnetically supported between the two ends of the coil cores 41 that have the radially inwardly directed stator poles 43. It is the longitudinal limbs of the coil cores 41 that are mutually aligned in parallel with one another, that extend in parallel with the axial direction A and that surround the rotor 3 that gave the temple motor its name because these parallel longitudinal limbs are reminiscent of the columns of a temple.

It is a further feature of the temple motor that the windings 42 of the stator 4 are each arranged around the longitudinal limbs of the coil cores 41 and are thus arranged outside the magnetic rotor plane C; beneath the magnetic rotor plane C in accordance with the representation. The windings 42 are preferably arranged beneath the magnetically effective core 31. The windings 42 are therefore not arranged in the plane in which the rotor 3 is driven and supported in the operating state. Unlike other electromagnetic rotary drives in which the windings of the stator are arranged such that the coil axes each lie in the magnetic rotor plane, that is in the plane in which the rotor is driven and supported, in the temple motor, the windings 42 of the stator 2 are arranged such that the axes of the windings 42 stand perpendicular on the magnetic rotor plane C and are thus aligned in parallel with the axial direction A.

It is naturally understood that the invention is not restricted to such embodiments as temple motors. Numerous other designs of the stator 4 are also possible. It is only essential that the rotor 3 can be contactlessly magnetically be driven to rotate about the axial direction in the operating state.

In accordance with the invention, the mixing apparatus 1 has a bar 8 extending in the axial direction A and a mechanical limiting element 9 that is fixed with respect to the mixing tank 2 and that cooperates with the bar 8 to at least limit a tilt of the robot 3 in the operating state. It is in this respect meant by a tilt of the rotor 3 that the magnetic rotor plane C of the rotor no longer stands exactly perpendicular on the axial direction A, but rather includes an angle different than 90° with it. This is equivalent to the fact that the magnetic rotor plane C and the radial plane in which the rotor 3 is supported are no longer congruent and are no longer parallel with one another, but rather include an angle different from zero with one another.

An axial tilt of the rotor 3 means that the non-tilted rotor 3 is displaced in the axial direction A without being tiled in so doing. In this case, the magnetic rotor plane C is parallel with the radial plane, but no longer congruent therewith.

The bar 8 extending in the axial direction A is rotationally fixedly connected to the rotor 3 and cooperates with the limiting element 9 fixed with respect to the mixing tank 2. Two different embodiments are generally possible in this respect.

In accordance with a first preferred embodiment, the limiting element 9 is configured as a tilt limitation 91. This means that the bar 8 rotates free of contact with respect to the tilt limitation 91 in the operating state with a non-tilted rotor 3—that is when the magnetic rotor plane C of the rotor 3 is perpendicular to the axial direction A. Only on a tilt of the rotor 3 does the bar 8 come into physical contact with the limiting element 9 configured as a tilt limitation 91, whereby the tilt of the rotor 3 is limited.

In accordance with a second preferred embodiment, the limiting element 9 is configured as a mechanical bearing 92 for the bar 8, in particular as a radial bearing. In this second preferred embodiment, the limiting element 9 is therefore a mechanical bearing 92 known per se so that there is also a contact between the limiting element 9 and the bar 8 supported by it with a non-tilted rotor 3.

The bar 8 can be produced in one piece and with a constant, non-variable length in the axial direction A both in the first and in the second preferred embodiment. It is, however, alternatively also possible that the bar 8 comprises a plurality of parts or segments arranged concentrically in one another, for example tubes that are displaceable relative to one another in the axial direction such that the bar can, like a telescopic antenna, be extended in its length or can be pushed together to the length of the individual parts or segments in a known manner.

Figure 12:
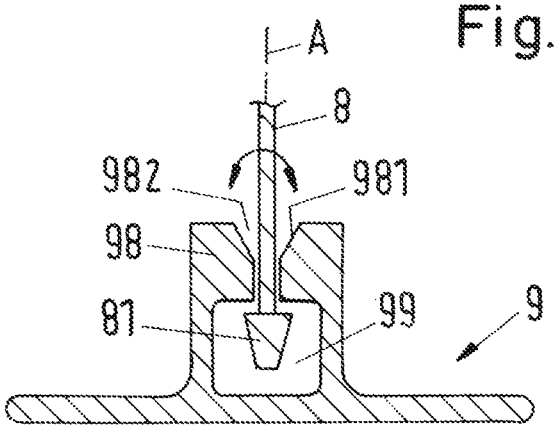

In the first embodiment of the limiting element 9 as a tilt limitation 91, which is shown in FIG. 12, the bar 8 rotates with small clearance free of contact with respect to the limiting element 9 configured as a tilt limitation in the operating state with a non-tilted rotor 3 and a tilt of the rotor 3 is limited by a physical contact between the bar 8 and the limiting element 9.

In the first embodiment shown in FIG. 1, the cylindrically designed bar 8 is arranged at the center of the rotor 3 so that the axis of the bar 8 coincides with the axial direction A with a non-tilted rotor 3. The bar 8 extends through the total mixing tank 2 with respect to the axial direction A. The limiting element 9 is arranged inwardly disposed at the top 23 of the mixing tank, and indeed such that the center of the limiting element 9 is aligned with the center of the rotor 3. The limiting element 9 is designed as a sleeve here whose inner diameter ID is larger than the diameter D of the bar 8. On the assembly of the mixing apparatus 1, the bar 8 is introduced into the limiting element 9, with the length of the bar 8 and its diameter D being dimensioned such that there is a clearance S between the inner wall of the limiting element 9 and the bar 8. The bar 8 is dimensioned with respect to the axial direction A such that it is also received free of contact by the limiting element 9 in the axial direction A.

The rotor 3 is passively magnetically stabilized, i.e. not controllable, in the stator 4. This means that if a tilt of the rotor 3 occurs in the operating state, magnetic restoring forces are thereby invoked that effect a torque with respect to the axial direction A on the rotor 3 that moves the rotor 3 back into its non-tilted position. These magnetic restoring forces are typically reluctance forces that are generated by the tilt of the rotor 3. This passive magnetic stabilization of the rotor 3 against tilts should also not be influenced by the limiting element 9. The rotor 3 rotates contactlessly in the stator 4 in the operating state and the bar 8 also rotates contactlessly in the limiting element 9 configured as a tilt limitation 91 with a tilt-free rotor 3. If a tilt of the rotor 3 occurs in operation, it is first compensated by the passive magnetic stabilization of the rotor 3 that moves the rotor 3 back into its non-tilted position without there being any physical contact between the bar 8 and the limiting element 9.

Only when the tilt of the rotor 3 becomes too great or too strong does a physical contact between the limiting element 9 configured as a tilt limitation 91 and the bar 8 occur that then limits the maximum tilt of the rotor 3. A further increase in the tilt of the rotor 3 is prevented by this physical contact with the limiting element 9.

In this first preferred embodiment of the limiting element 9 as a tilt limitation 91, it is characteristic that the bar 8 can rotate contactlessly in the limiting element 9 with a non-tilted rotor 3 and on tilts of the rotor 3 that can be reversed by its passive magnetic support. Only when the tilt of the rotor 3 could become too large does the physical contact between the bar 8 and the limiting element 9 prevent a further increase in the tilt of the rotor 3.

The tilt limitation 91 is thus not a fully-fledged bearing for the rotor 3, but only a limit for the tilt of the rotor 3.

The clearance S between the bar 8 and the tilt limitation 91 is preferably dimensioned such that the bar 8 comes into contact with the tilt limitation 91 before the rotor 3 comes into physical contact with the wall or the base of the bucket 21. How much the rotor 3 can be tilted before such a contact with the bucket 21 comes about can be determined in a simple manner. The clearance S can then be selected such that a contact between the rotor 3 and the bucket 21 is reliably avoided.

The bar 8 is preferably also manufactured from plastic and can either be molded to the jacket 32 of the rotor 3 as an integral component or—as the representation in FIG. 1 shows—the bar 8 is manufactured as a separate component that is then plugged into a central opening of the rotor 3 such that the bar 8 is rotationally fixedly connected to the rotor 3. It is naturally also possible to adhesively bond or weld the bar 8 to the rotor 3. It is furthermore possible that the bar 8 comprises a metal, for example a stainless steel or aluminum. As already mentioned, the bar 8 can be configured in one piece with a non-variable length in the axial direction A or the bar 8 comprises a plurality of segments that are arranged concentrically in one another and that are movable relative to one another in the axial direction A so that the bar 8 can be pushed together or pulled apart in the manner of a telescope. The tilt limitation 91 preferably comprising plastic can be manufactured as a separate component and can then be fixed to the top 23 of the mixing tank 2, for example by welding or adhesive bonding. It is naturally also possible that the tilt limitation 91 is manufactured as an integral component of the top 23. The tilt limitation 91 can naturally also fully or partly comprise a metal material.

In the first embodiment shown in FIG. 1, a plurality of vanes 6 for mixing or stirring the substances are disposed in the mixing tank 2. The vanes 6 are preferably manufactured from plastic and are arranged at and fastened to the bar 8. In this respect, the vanes 6 are arranged at different levels with respect to the axial direction A so that the vanes 6 are distributed over the total mixing tank 2 in the axial direction A. A particularly homogeneous intermixing of the substances in the mixing tank 2 can hereby be implemented. Since the bar 8 having the vanes 6 fastened thereon is rotationally fixedly connected to the rotor 3, the vanes 6 can be driven to rotate about the axial direction A by the rotation of the rotor 3. The vanes 6 can be produced as separate components that are then connected to the bar 8, for example by welding or adhesive bonding, or the vanes 6 can be integral components of the bar 8.

Unlike the embodiment shown in FIG. 1, it is naturally also possible that all the vanes 6 are combined to form an impeller and one or more such impellers are disposed at the bar 8. It is furthermore possible, alternatively or additionally, to provide the vanes directly on the rotor 3 or directly on the jacket 32 of the rotor.

As already mentioned, in accordance with a second preferred embodiment, the limitation element 9 can also be configured as a mechanical bearing 92 that forms a fully-fledged bearing, in particular a fully-fledged bearing for the bar 8. In the following, only the differences will be explained for the first embodiment shown in FIG. 1 that result when the limiting element 9 in accordance with the second embodiment is a mechanical bearing 92. Otherwise the preceding explanations also apply in the same or in accordingly the same manner to this second preferred embodiment.

Figure 2:
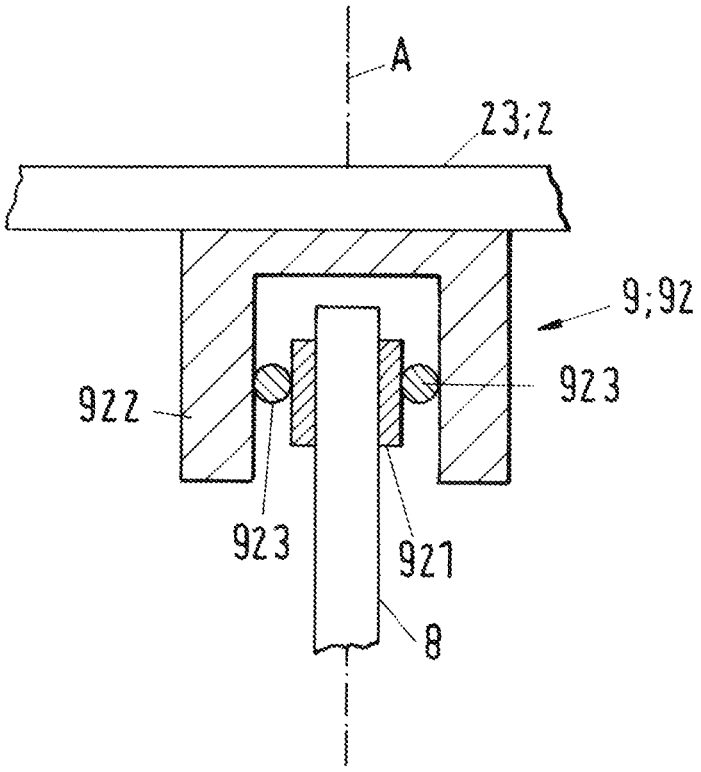
FIG. 2 is an embodiment of the limiting element as a roller element bearing.

FIG. 2 shows in a very schematic representation a part of the top 23 of the mixing tank 2 with the fastening element 9 that is fastened thereto and that is configured as a mechanical bearing 92 as well as the end of the bar 8 that is supported by the mechanical bearing 92. It is preferred in this respect if the bearing 92 is primarily configured as a radial bearing and not as an axial bearing for the bar 8. The mechanical bearing 92 in accordance with FIG. 2 is configured as a roller element bearing that comprises, in a manner known per se, an inner bearing body 921 that is rotationally fixedly connected to the bar 8 such that the inner bearing body 921 rotates together with the bar 8, an outer bearing body 922 that is stationary with respect to the mixing tank 2, that is, for example, is fixed to the top 23, and a plurality of rolling elements 923 that are arranged between the inner bearing body 921 rotating in the operating state and the stationary outer bearing body 922. In this respect the rolling elements 923 can all have configurations known from roller element bearings. The rolling elements 923 can in particular be balls (ball bearings) or also cylindrical or conical or frustoconical rolling elements 923. The bar 8 is supported in a manner known per se by the mechanical bearing 92. Unlike the first preferred embodiment, the bar 8 is therefore constantly—also with a non-tilted rotor 3—in physical contact with the mechanical bearing 92 during operation.

There are naturally a number of variations with respect to the design of the mechanical bearing 92; it is also by no means necessary that the mechanical bearing 92 is designed as a roller element bearing. It is thus, for example, also possible to configure the mechanical bearing 92 as a slide bearing or as a fluid-lubricated bearing or as a hydrodynamic bearing.

Figure 3:
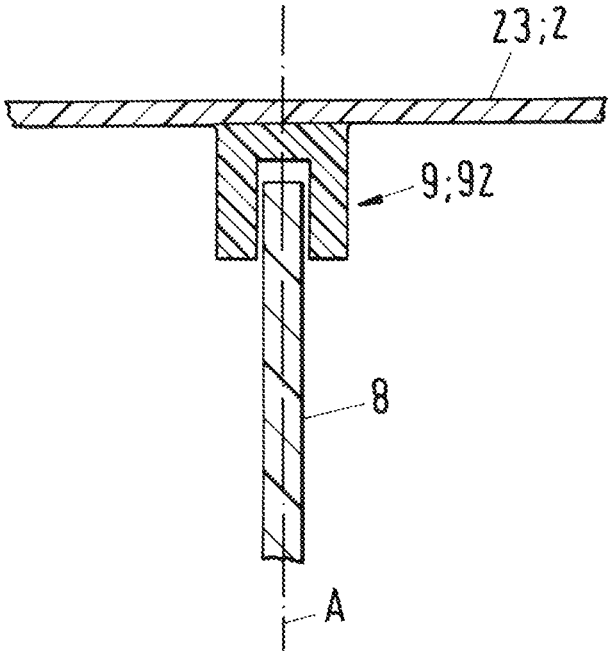
FIG. 3 is an embodiment of the limiting element as a slide bearing.

FIG. 3 shows a particularly simple variant in which the mechanical bearing 92 is configured as a slide bearing. The bearing 92 is in this respect configured as a sleeve fixed to the cover 23 of the mixing tank 2 and receiving the end of the bar 8. In this respect, the inner diameter of the sleeve is substantially of the same size as the diameter of the bar 8 so that the bar 8 slides long the inner wall of the sleeve during operation. The axial end of the bar 8, more precisely its axial end surface, is in this respect not in contact with the sleeve, but only the jacket surface of the bar 8. The variant of the mechanical bearing 92 shown in FIG. 3 substantially corresponds in a design aspect to the limiting element 9 shown in FIG. 1, but with the clearance S between the sleeve of the bearing 92 and the bar 8 being zero or being at least almost zero in the embodiment shown in FIG. 3 so that a slide seal is realized. All the materials typical for slide seals are suitable as materials for the counter-moving partners, namely the sleeve of the bearing 92 and the bar 8; for instance, the sleeve of the bearing 92 and the bar 8 can, for example, be produced from a plastic, with different plastics naturally also being able to be used for both components 92, 8. The sleeve of the bearing 92 can, for example, be produced from the materials know under the brand name of Teflon, polytetrafluorotheylene (PTFE) or perfluoralkoxy polymers (PFA) that have good sliding or rubbing properties. However, other material pairs are also suitable, for example metal/polyethylene (PE) or other combinations of metal/plastic. In this respect, the bar 8 is then preferably produced from a metal and the sleeve of the bearing 92 from a plastic. Bearings or sleeves and bars that do not comprise fluoropolymers such as PTFE or PFA or do not comprise parts of these materials are particularly suitable when the mixing apparatus 1 or parts thereof should be sterilized using gamma rays.

Figure 4:
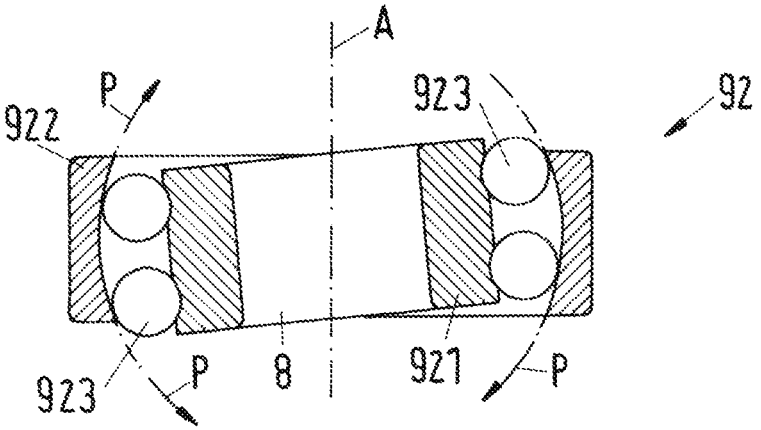
FIG. 4 is an embodiment of the limiting element as a pendulum bearing.

In the second preferred configuration of the limiting element 9 as a mechanical bearing 92, it is in particular preferred if the mechanical bearing 92 is configured as a pendulum bearing that can additionally take up tilts of the bar 8. Pendulum bearings per se are known in numerous embodiments. As an example, FIG. 4 illustrates the basic design of an embodiment in which the mechanical bearing 92 is configured as a pendulum ball bearing, that is as a roller element bearing. The inner bearing body 921, that is rotationally fixedly connected to the bar 8 rotating in the operating state, is substantially cylindrical, whereas the inwardly disposed limitation surface of the stationary outer bearing body 922, that faces the inner bearing body 921, is curved, and in particular spherically curved. If now, a tilt of the bar 8 takes place, the rolling elements 923 configured as balls can roll off on the curved limitation surface of the outer bearing body 922 as is indicated by the arrows with the reference symbol P in FIG. 4. In this manner, the pendulum ball bearing can also take up or compensate tilt moments that are introduced into the bearing 92 by a tilt of the bar 8.

The rolling elements 923 can also alternatively be configured in a manner known per se in the form or rolls or cylinders in the configuration as a pendulum bearing. It is also preferred in the configuration of the mechanical bearing 92 as a slide bearing if the mechanical bearing 92 is configured as a pendulum bearing. In principle, all known embodiments of pendulum sliding bearings such as spherical slide bearings or joint slide bearings per se are suitable for this.

Figure 5:
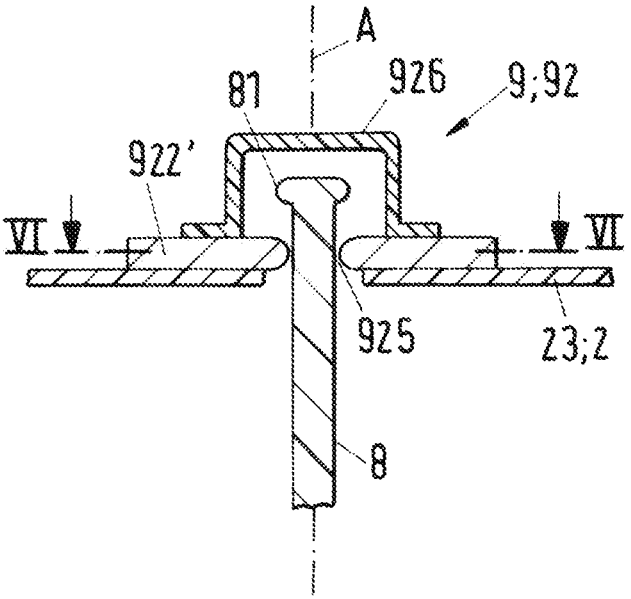
FIG. 5 is an embodiment of the limiting element as a pendulum slide bearing.

A particularly simple embodiment of the mechanical bearing 92 as a pendulum slight bearing is shown in a schematic representation in FIG. 5. In addition, FIG. 6 shows a section along the line VI-VI in FIG. 5.

Figure 6:
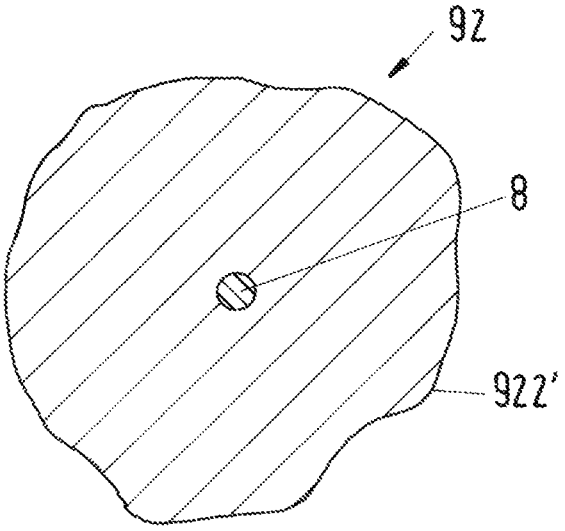
FIG. 6 is a section through the limiting element of FIG. 5 along the line VI-VI in FIG. 5.

In the embodiment shown in FIGS. 5 and 6, the limiting element 9 configured as a mechanical bearing 92 is arranged outwardly disposed at the top 23 of the mixing tank 2, that is outside the mixing tank 2. It is naturally understood that the limiting element 9 or the bearing 92 can in accordingly the same manner also be arranged inwardly disposed at the top 23 or at the base 22 of the mixing tank 2.

In the embodiment in accordance with FIG. 5 and FIG. 6, the outer bearing body 922 of the mechanical bearing 92 is configured as a disk 922', for example as a circular disk 922', that has an opening 925 at its center through which the bar 8 extends. The bar 8 in this embodiment itself forms the inner bearing body. In this respect, the opening 925 in the disk 922' is dimensioned with respect to its diameter such that the bar 8 contacts the inwardly disposed boundary of the opening 925 so that a slide bearing is hereby realized. The boundary of the opening 925 is preferably configured in rounded form such as is shown in FIG. 5. This embodiment shown in FIG. 5 and FIG. 6 represents a simple pendulum bearing because the bar 8 can carry out tilt movements in the opening 925. The two counter-moving partners can also both be produced from plastic in the configuration as pendulum slide bearings 92 or one of the two counter-moving partners can be produced from metal and the other from plastic.

The disk 922' is here attached to the outside of the mixing tank 2, namely to its top 23, and can, for example, be fastened to the top 23 of the mixing tank 2 by adhesive bonding or welding. So that no liquid or no gas can exit the mixing tank 2 along the bar 8 into the environment during operation, a closure cap 926 is disposed at the disk 922' that is preferably manufactured from a plastic and that completely surrounds the end of the bar 8 at the top in accordance with the illustration. The closure cap 926 is connected to the disk 922' in a fluid-tight manner, for example by adhesive bonding, welding or another otherwise sealing connection, e.g. a snap-in connection.

So that the bar 8 cannot slip out of the opening 925 during operation and is thus secured against a separation from the mechanical seal 92, the bar 8 preferably has, at its end remote from the rotor 3, a terminating element 91 whose diameter is larger than the diameter of the opening 925. In the assembly of the bar 8, this terminating element 81 can be moved through the opening 925 due to elastic deformations.

The now following explanations of further embodiments and variants of the invention apply in the same manner or in accordingly the same manner both to the first preferred embodiment in which the limiting element 9 is configured as a tilt limitation 91 and to the second preferred embodiment in which the limiting element 9 is configured as a mechanical bearing 92. Reference is therefore made in the following—apart from explicitly mentioned exceptions—generally to the limiting element 9, with this being able to be configured in each case both as a tilt limitation 91 and as a mechanical bearing 92.

Figure 7:
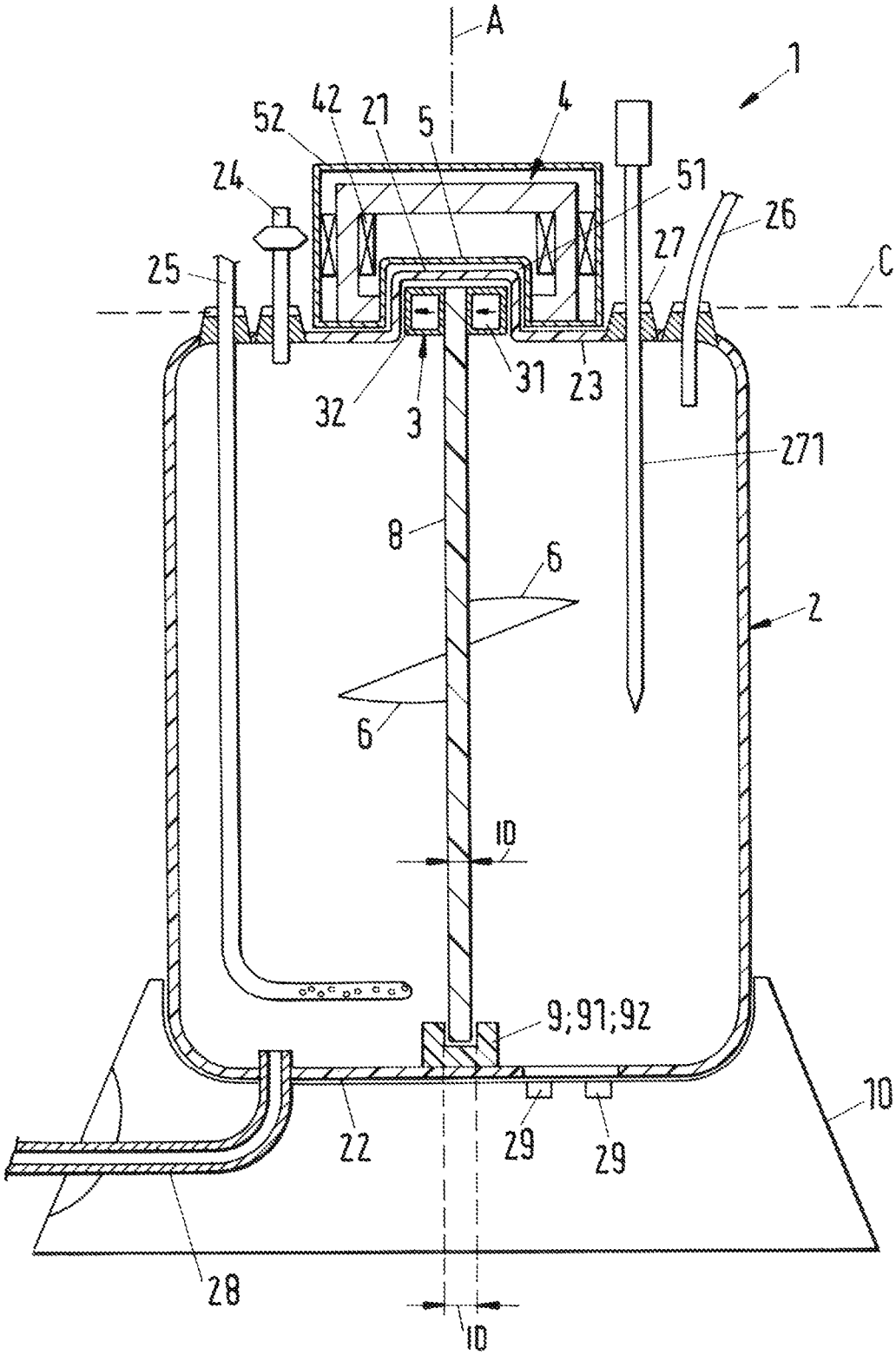
FIG. 7 is a sectional representation of a second embodiment of a mixing apparatus in accordance with the invention.

FIG. 7 shows in a longitudinal section along the axial direction A a second embodiment of the mixing apparatus in accordance with the invention. In the following, only the differences from the above-described first embodiment will be looked at. The reference numerals in particular have the same meaning as has already been explained in connection with the first embodiment described above. It is understood that all the above explanations also apply in the same manner or accordingly in the same manner to the second embodiment.

The second embodiment shown in FIG. 7 is here configured as a bioreactor. Unlike the first embodiment, the rotor 3 and the stator 4 are arranged at the top 23 of the mixing tank 2 in the second embodiment. The bucket 21 is arranged at the center of the top 23 and is in turn configured—with respect to the mixing tank 2—outwardly as a protuberance. The separating can 5 having the stator 4 arranged therein is accordingly arranged outwardly on the top 23 so that its recess 51 receives or surrounds the bucket 21 with the rotor 3 arranged therein in accordingly the same manner as was already described for the first embodiment.

The limiting element 9 is fixed opposite the center of the rotor 3 at the base 22 of the mixing tank 2 such that the limiting element 9 can receive the end of the bar 8.

The mixing tank 2 is arranged in a foot 10 that gives the mixing tank 2 a secure standing.

Further components of the mixing apparatus 1 that can e.g. be provided in an embodiment as a bioreactor are now also shown with an exemplary character in FIG. 7. A feed 26 is thus provided that extends through the wall of the mixing tank 2 and through which substances can be introduced into the mixing tank 2. A gas feed 25 is furthermore provided that extends through the wall of the mixing tank 2 and through which a gas, for example oxygen, can be introduced into the mixing tank 2. A gas feed 24 having a gas filter is furthermore provided that extends through the wall of the mixing tank 2. Gases such as carbon dioxide that are generated during biological processes in the mixing tank 2 can be led out of the mixing tank via the gas drain line 24. A further leadthrough 27 is also provided that extends through the wall of the mixing tank 2 and that can be used for receiving probes 271 or measurement sensors with which parameters can be monitored during the mixing process, e.g. pH, temperature, pressure, concentrations, etc. A drain line 28 which extends through the wall of the mixing tank 2 and through which substances can be led off from the mixing tank 2 or by which the mixing tank 2 can be emptied is provided at the base 22 of the mixing tank 2. Further leadthroughs 29 can also be provided that can be used for different purposes.

Figure 8:
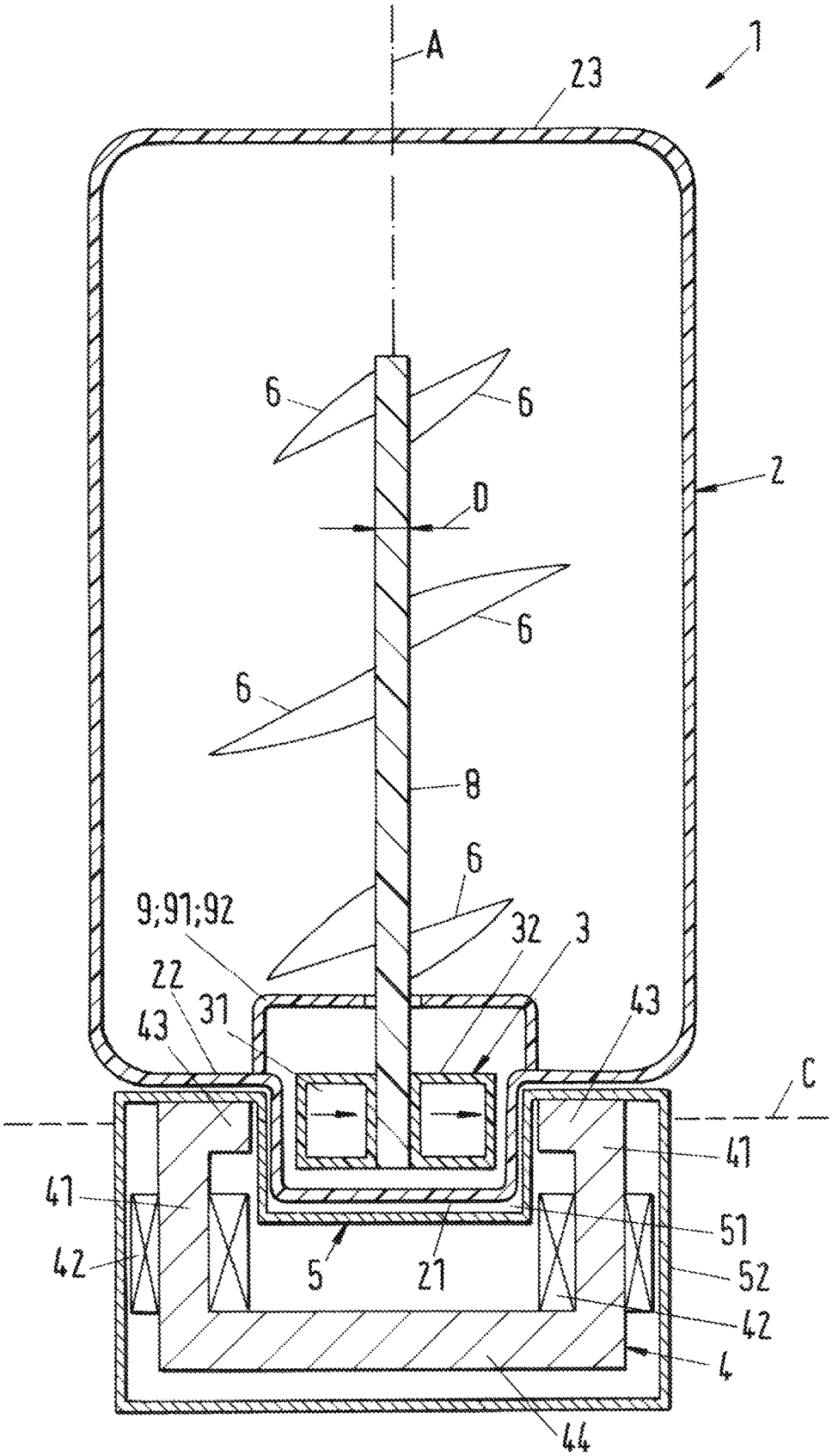
FIG. 8 is a sectional representation of a third embodiment of a mixing apparatus in accordance with the invention.

FIG. 8 shows in a longitudinal section along the axial direction A a third embodiment of the mixing apparatus 1 in accordance with the invention. In the following, only the differences from the above-described embodiments will be looked at. The reference numerals in particular have the same meaning as has already been explained in connection with the embodiments described above. It is understood that all the above explanations also apply in the same manner or accordingly in the same manner to the third embodiment.

The third embodiment essentially differs from the first two embodiments in that the bar 8 does not extend through the total mixing tank 2 with respect to the axial direction A, but rather ends within the mixing tank 2, that is considerably spaced apart from its top 23.

Figure 9:
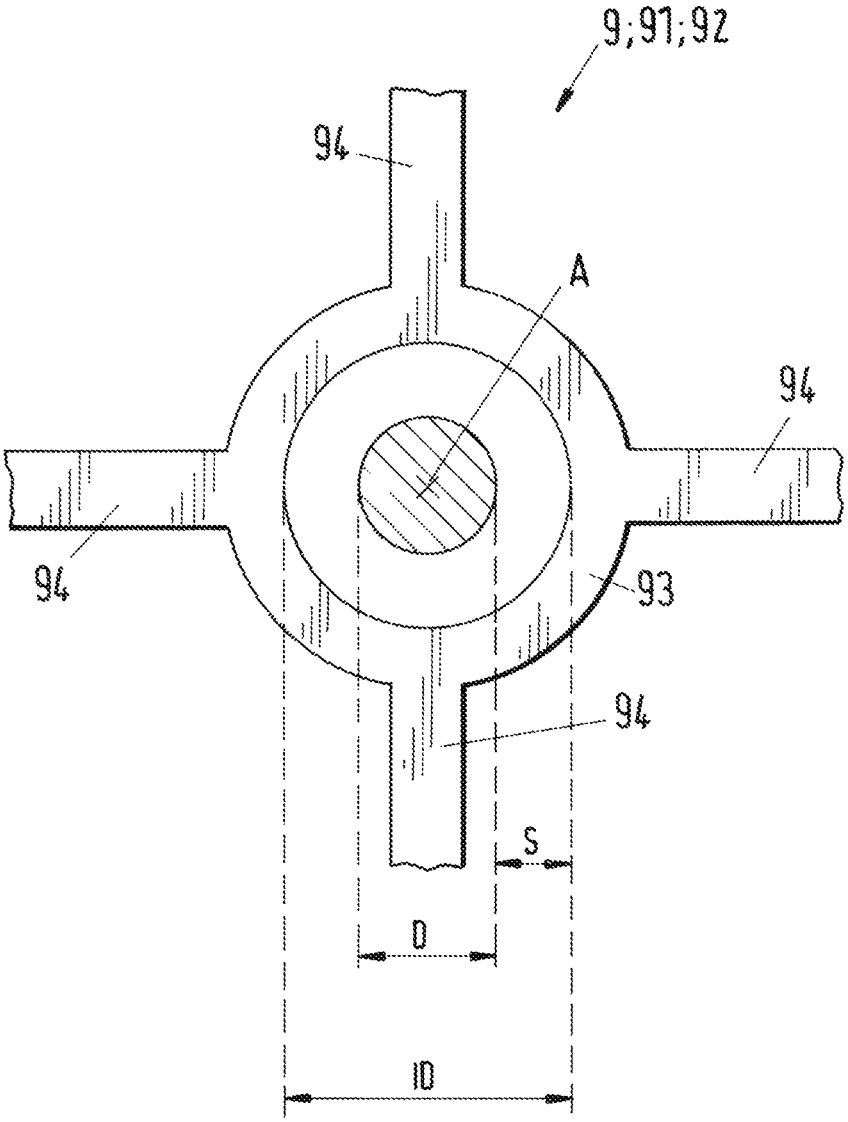
FIG. 9 is a plan view of the limiting element of the third embodiment from the axial direction.

The limiting element 9 is here disposed at and fixed to the base 22 of the mixing tank 2. For better understanding, FIG. 9 shows a plan view of the limiting element 9 of the mixing apparatus 1 shown in FIG. 8. The limiting element 9 comprises a central ring 93 for receiving the bar 8.

In this respect, in the case of the first preferred embodiment of the limiting element 9 as a tilt limitation 91, the inner diameter ID of the ring 93 is larger than the diameter D of the bar 8. On assembling the mixing apparatus 1, the bar 8 is led through the ring 93, with the diameter D of the bar being dimensioned such that the clearance S that is fixed by the difference of the inner diameter ID of the ring 93 and the diameter D of the bar 8 is present between the inner wall of the ring 93 and the bar 8. In this embodiment, the bar 8 therefore extends through the limiting element 9 in the axial direction A.

In the case of the second preferred embodiment of the limiting element 9 as a mechanical bearing 92, the inner diameter ID of the ring 93 is the same size or almost the same size as the diameter of the bar 8 so that the clearance S is zero or approximately zero. The ring 93 then forms a mechanical slide bearing 92 for the bar 8, preferably a fluid-lubricated slide bearing 92 that is lubricated by the process fluid or by one of the process fluids that is/are located in the mixing tank 2 in the operating state. It can be advantageous in this respect if a ring-shaped insert (not shown) is disposed in the ring 93 and is produced from a material particularly suitable for sliding friction, for example a plastic such as the already mentioned Teflon.

For both preferred embodiments, namely as a tilt limitation 91 or as a mechanical bearing 92, the limiting element 9 furthermore comprises a plurality of arms 94, four here, that start, equidistantly distributed, in each case at the radially outer margin of the ring 93 and extend from there first in the radial direction and then in the axial direction A up to the base 22 of the mixing tank 2 where they are each fixed. Depending on how long the bar 8 is, the arms 94 of the limiting element 9 can also be fixed to the top 22 of the mixing tank 2.

It is naturally also possible in such embodiments in which the bar 8 does not extend through the whole mixing tank 2 with respect to the axial direction A to design the limiting element 9 such that it receives an end of the bar 8 and is not fully penetrated by the bar 8.

Figure 10:
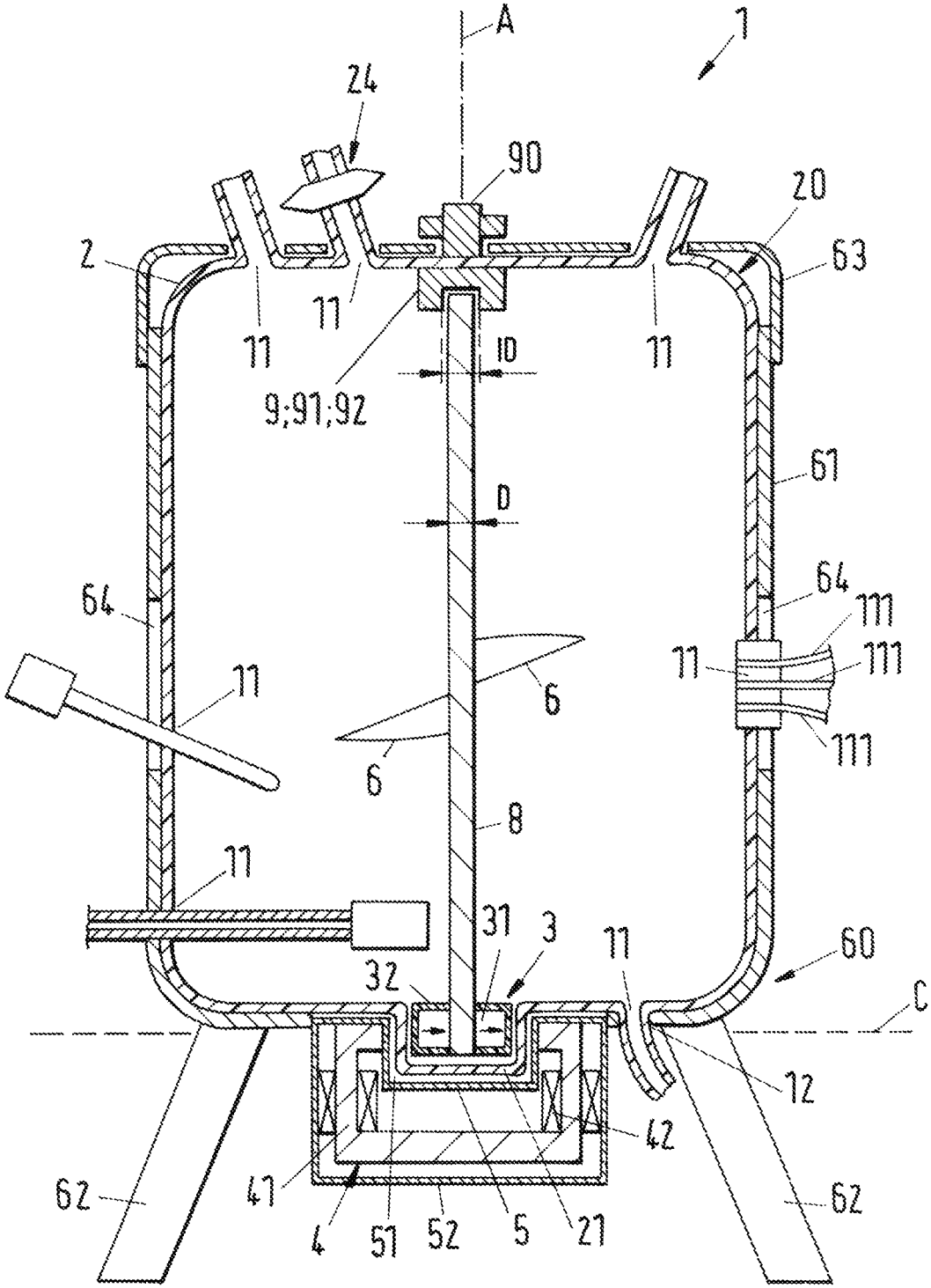
FIG. 10 is a sectional representation of a fourth embodiment of a mixing apparatus in accordance with the invention.

FIG. 10 shows in a longitudinal section along the axial direction A a fourth embodiment of the mixing apparatus 1 in accordance with the invention. In the following, only the differences from the above-described embodiments will be looked at. The reference numerals in particular have the same meaning as has already been explained in connection with the embodiments described above. It is understood that all the above explanations also apply in the same manner or accordingly in the same manner to the fourth embodiment.

The fourth embodiment of the mixing apparatus 1 in accordance with the invention is specifically designed for applications with a single use. To ensure the purity or the sterility of those components of the mixing apparatus 1 which come into contact with the substances to be mixed or stirred, the fourth embodiment comprises a single-use apparatus which is designated as a whole by the reference numeral 20 and is configured for a single use and comprising a reusable apparatus which is designated as a whole by the reference numeral 60 and which is configured for permanent use, that is for multiple use. In this respect, the single-use apparatus 20 comprises those components which come into contact with the substances to be mixed during the mixing process. That is, in particular the mixing tank 2, the rotor 3, all the vanes 6, the bar 8 and the limiting element 9.

In this respect those components or parts are meant by the term "single-use apparatus" and other compound words having the element "single-use" such as single-use part, single-use component, etc. which are configured for single use, that is which are used only one single time as intended and are then disposed of. A new, previously unused single-use part then has to be used for a new application. In the design or configuring of the single-use apparatus 20, essential aspects are therefore that the single-use apparatus 20 can be manufactured as simply and economically as possible, causes few costs and can be manufactured from materials which are available as inexpensively as possible. Another important aspect is that the single-use apparatus 20 can be assembled in as simple a manner as possible with the reusable apparatus 60 to form the mixing apparatus 1. The single-use apparatus 20 should therefore be able to be replaced in a very simple manner without a high installation effort being required for this purpose. The single-use apparatus 20 should particularly preferably be able to be assembled with or separable from the reusable apparatus 60 without using tools.

It is also an important aspect that the single-use apparatus 20 can be disposed of as simply as possible after its use. Those materials are therefore preferred which bring about environmental pollution which is as low as possible, in particular also during their disposal.

In the design of the single-use apparatus 20, the mixing tank 2 is designed as a flexible mixing tank 2 that is manufactured from a plastic. The mixing tank 2 is preferably a flexible pouch, for example a plastic sack or a sack of a synthetic material, which can be folded together so that it takes up as little space as possible during storage. The mixing tank 2 in the fourth embodiment has a plurality of inlets or outlets 11 that, as described above, can be used, for example, for feeding and draining substances and gases or for the reception of probes or measurement sensors. In this respect, for example, hoses or hose-like continuations are provided at some of the inlets or outlets 11 in a manner known per se; they are manufactured from plastic and are welded to the mixing tank 2 such that substances can be fed or drained through these hoses. Other inlets or outlets 11 can also be designed as self-sealing passages in a manner known per se.

So-called sampling ports 111 can in particular be adhesively bonded or welded to the mixing tank 2. They are in this respect short hose-like plastic structures through which, for example, samples can be removed from the mixing tank 2. Each sampling port 111 is in this respect typically secured in a manner known per se by a clamp at its end projecting from the mixing tank 2 such that no unwanted substances can move through these sampling ports 111 into the interior of the mixing tank 2.

The gas drainage line 24 having the gas filter can also be provided at the mixing tank 2, with the gas filter also being configured for single use.

The cylindrical bucket 21 for the reception of the rotor 3 is preferably of stable shape and is produced from a plastic. However, it can also, for example, be designed in the form of a flexible hose or pouch composed of a plastic film. The limiting element 9, the bar 8 and all the vanes 6 are designed as stable in shape and are preferably produced from a plastic. The shape-stable parts that are fixed to the mixing tank 2, that is in particular the bucket 21 and the limiting element 9, can be connected to the flexible mixing tank 2 in a fluid-tight manner by adhesive bonding or welding. It is naturally also possible in the design for single use to manufacture the bar 8 and/or the limiting element 9 fully or partly from a metal material. The limiting element 9 can thus, for example, be a metal sleeve, e.g. of aluminum. The bar 8 can also comprise a metal material in the design for single use to ensure a greater stability, for example. Since both the limiting element 9 and the bar 8 are components of a very simple design, in particular with respect to their geometry, they can also be manufactured very inexpensively.

The reusable apparatus 60 comprises a stable-shape support tank 61 for receiving the mixing tank and comprises the stator 4. The support tank 61 has a plurality of feet 62 on which the support tank 61 stands at its base. At least one opening 12 is furthermore disposed in the base so that substances can be drained out of the mixing tank 2 or can be introduced into it. The substantially cylindrically designed support tank 61 is open at its upper side or optionally—as shown in FIG. 10—includes a removable cover 63 so that the mixing tank 2 can be introduced into the support tank 61 without problem. Windows 64 can furthermore be provided at the wall of the support tank 61 and an optical access to the mixing tank 2 is possible through them.

The substantially cylindrically designed separating can 5 and the stator housing 52 having the sensor 4 contained therein are centrally arranged at the base of the support tank 61. The separating can 5 is integrated in the stator housing 52 or is fixed thereto. The separating can 5 extends downwardly in accordance with the illustration in the direction of its cylinder axis such that it can coaxially receive the bucket 21 in the assembled state. The dimensions of the separating can 5 and of the bucket 21 are adapted to one another in this respect such that the recess 51 of the separating can 5 tightly surrounds the bucket 21 in the assembled state and its jacket surface contacts the jacket surface of the bucket 21.

The stator housing 52 having the separating can 5 is preferably fixed to the base of the support tank 61 by screws.

The stator 4 is arranged in the separating can 52 and is designed as a bearing and drive stator by which the rotor 3, in the operating state, can be driven contactlessly and can be magnetically contactlessly supported with respect to the stator 3.

The assembly of the single-use apparatus 20 and of the reusable apparatus 60 to form the mixing apparatus 1 is extremely simple and can be carried out fast and in particular without tools. For this purpose, the mixing tank 2 that is typically folded together for storage or is wound around the bar 8 and that has the rotor 3 located thereat, the limiting element 9 and the vanes 6 is removed from its packaging and is placed into the support tank 61 and the bucket 21 having the rotor 3 is inserted into the separating can 5. If the bar 8 is not yet connected to the rotor 3, the bar 8 is inserted into the rotor 3 and is then brought into active connection with the limiting element 9. The cover 63 is optionally placed on to close the support tank 61. The mixing apparatus 1 is then already ready for use. After use, the mixing tank 2 having the bucket 21, the bar 8, the limiting element 9 and the rotor 3 is simply pulled out of the support tank 61. The bucket 21 in this respect simply releases from the separating can 5. This particularly simple and problem-free connection or separation of the single-use apparatus 20 to or from the reusable apparatus 60 thus takes account of a substantial aspect of the embodiment for the single use.

It can in particular be advantageous in the design of the mixing tank 2 as a flexible mixing tank 2 if the limiting element 9 comprises a fixing 90 by which the limiting element can be fixed with respect to the reusable apparatus 60. In the embodiment shown in FIG. 10, this fixing 90 comprises a pin or a threaded pin that engages through a corresponding opening in the cover 63 of the reusable apparatus 60 and is then fixed to the cover 63 by a nut or of another suitable measure.

The rotor 3 can—as shown in FIG. 10—be designed with a permanent magnet as a magnetically effective core 31. It can, however, also in particular be advantageous in the design as a single part in dependence on the application to design the rotor 3 as free of permanent magnets, that is without permanent magnets and free of coils. The magnetically effective core 31 is then, for example, produced from a soft-magnetic material such as iron, nickel-iron or silicon-iron. This measure allows an inexpensive embodiment of the rotor 3 as a single-use part since in particular no rare earths such as neodymium or samarium or compounds or alloys thereof are necessary for the production of the rotor 3 which are frequently used for the manufacture of permanent magnets.

In such embodiments in which the rotor 3 is designed without permanent magnets, it is particularly preferred if one or more permanent magnets are provided in the stator 4 to generate a permanent magnetic premagnetization flux such that the total magnetic flux required for the drive and for the support does not have to be generated as an electromagnetic flux.

Since the components of the single-use apparatus 20, that is the mixing tank 2, the rotor 3, all the vanes 6, the bar 8, and the limiting element 9 are configured for single use, the parts produced from plastic should be manufactured from a commercial plastic that is as inexpensive as possible. A further substantial aspect is that the single-use apparatus 20 or its components has/have to be able to be sterilized for certain fields of application. In this respect, it is particularly advantageous if the single-use apparatus 20 can be gamma sterilized. In this type of sterilization, the element to be sterilized is acted on by gamma radiation. The advantage of the gamma sterilization, for example in comparison with steam sterilization, in particular lies in the fact that the sterilization can also take place through the packaging. It is common practice especially with single-use parts that the parts are brought into the packaging after their manufacture and are then stored for some time before they are delivered to customers. In such cases, the sterilization takes place through the packaging, which is not possible with a steam sterilization or another method.

The single-use apparatus 20, on the other hand, offers the great advantage due to its only single usability that no value has to be placed on a good cleaning capability of the single-use apparatus 20 in the construction because the single-use apparatus does not have to be cleaned when used as intended. It is furthermore not necessary as a rule that the single-use apparatus 20 or its components have to be sterilized more than once. This is in particular a great advantage with the gamma sterilization because the application of gamma radiation to plastics can result in degradations so that a multiple gamma sterilization can make the plastic unusable.

Since as a rule a sterilization at high temperatures and/or at a high (steam) pressure can be dispensed with for single-use parts, less expensive plastics can be used, for example those which cannot withstand high temperatures or which cannot be exposed to high temperature values and high pressure values a multiple of times.

When taking all these aspects into account, it is therefore preferred to use those plastics for the manufacture of the single-use apparatus 20 which can be gamma sterilized at least once. The materials should in this respect be gamma-stable for a dose of at least 40 kGy to allow a single-time gamma sterilization. In addition, no toxic substances should arise in the gamma sterilization. It is additionally preferred for all materials which come into contact with the substances to be mixed to satisfy USP Class VI standards.

The following plastics are, for example, preferred for the manufacture of the flexible mixing tank 2: Polyethylenes (PE), low density polyethylenes (LDPE), ultra low density polyethylenes (ULDPE), ethylene vinyl acetates (EVA), polyethylene terephthalates (PET), polyvinylchloride (PVC), polypropylenes (PP), polyurethanes (PU), silicones.

The following plastics are, for example, preferred for the manufacture of the bucket 21, of the bar 8, of the limiting element 8, of the vanes 6 and of the parts of the rotor 3 comprising plastic, that is e.g. the jacket 32: Polyethylenes (PE), polypropylenes (PP), low density polyethylenes (LDPE), ultra low density polyethylenes (ULDPE), ethylene vinyl acetates (EVA), polyethylene terephthalates (PET), polyvinylchloride (PVC), polyvinylidene fluorides (PVDF), acrylonitrile butadiene styrenes (ABS), polyacrylics, polycarbonates (PC).

These named plastic are inter alia also suitable for the manufacture of a shape-stable mixing tank 2 that is designed for multiple use.

Less suitable materials or even unsuitable materials for the manufacture of the plastic parts of the single-use apparatus 20 are, for example, the materials known under the trade name Teflon polytetrafluroethylenes (PTFE) and perfluooralkoxy polymers (PFA). There is namely the risk with these materials on gamma sterilization that hazardous gases arise such as fluorine which can then form toxic or harmful compounds such as hydrofluoric acid (HF).

If the mixing tank 2 is designed for multiple use, it can naturally also be manufactured from PTFE or PFA or also from a metal, for example from stainless steel or also from glass.

It is also preferred if the components comprising plastic can be manufactured by an injection molding process because this is a particularly inexpensive kind of manufacture.

Different variants for the design of the limiting element 9 that are suitable for all the above-described embodiments will be explained in the following by way of example with reference to FIGS. 11, 12 and 13. As already explained, the bar 8 and the limiting element 9 preferably cooperate such that the bar 8 is secured against a separation from the limiting element 9. In addition to the variant already described with the ring 93 of the limiting element 9 in which the bar 8 extends in the axial direction through the limiting element 9, FIGS. 11 to 13 show embodiments in which the limiting element 9 cooperates with the end of the bar 8 remote from the rotor 3.

Figure 11:
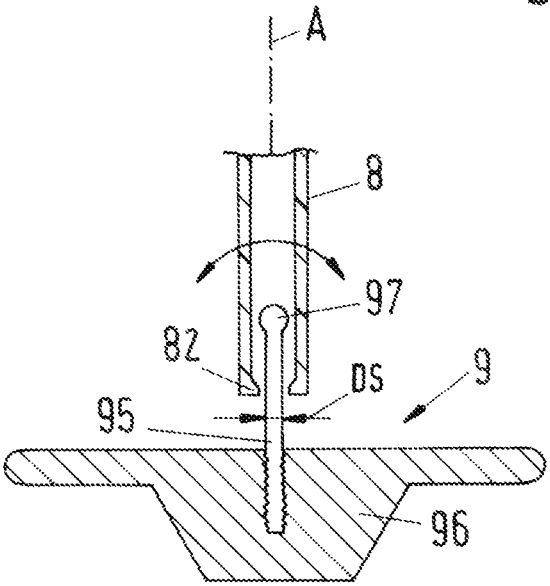
FIGS. 11-14 are different variants for the embodiment of the limiting element, each in a perspective representation.
Figure 13:
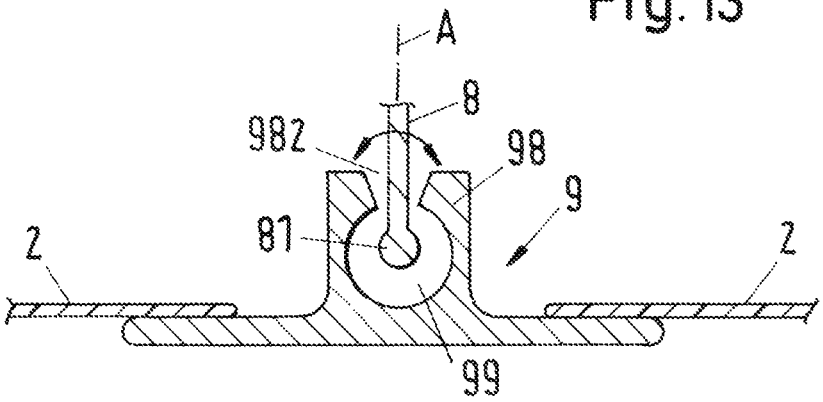

In the variants shown in FIGS. 12 and 13, the limiting element 9 is designed in this respect such that the end of the bar 8 remote from the rotor 3 is received by the limiting element 9, whereas the variant shown in FIG. 11 corresponds to an embodiment in which the end of the bar 8 remote from the rotor 3 is designed such that it surrounds a part of the limiting element 9.

The variant of the limiting element 9 shown in FIG. 11 comprises a pin 95 that projects out of a base body 96 of the limiting element 9 in the axial direction A. This pin 95 has at its end remote from the base body 96 a spherical head 97 that is designed to cooperate with the bar 8. The end of the bar 8 cooperating with this pin 95 is hollow and comprises a tongue 82 at its end that bounds the opening of the bar 8 such that the passage formed by the tongue 82 is, on the one hand, larger than the diameter DS of the pin and, on the other hand, smaller than the diameter of the spherical head 97. The spherical head 97 can thus be introduced in the form of a snap-in connection into the end of the bar 8.

In the first preferred embodiment of the limiting element 9 as a tilt limitation 91, the diameter of the spherical head 97 is dimensioned such that the spherical head 97 is received free of contact in the end of the bar 8 after its introduction into the end of this bar 8 as long as the rotor 3 is not tilted or is oriented in a tilt that can be compensated by the passively magnetic support. The spherical head 97 only contacts the inner wall of the bar 8, rolls off thereon and thus limits the maximum possible tilt of the rotor 3 when the tilt of the rotor 3 becomes too strong or too large. The tilt of the root 3 is indicated by the double arrow without a reference numeral in FIG. 11.

In the second preferred embodiment of the limiting element 9 as a mechanical bearing 92, the diameter of the spherical head 97 is dimensioned such that the spherical head 97 constantly contacts the inner wall of the bar 8—that is also with a non-tilted rotor 3—after its introduction into the end of the bar 8 and thus cooperates with this inner wall in the form of a slide bearing.

The variants for the limiting element 9 shown in FIGS. 12 and 13 are variants in which the end of the bar 8 remote from the rotor 3 is received by the limiting element 9. In these two variants, the bar 8 has at its end remote from the rotor 3 the terminating element 81 that is designed for receiving the limiting element 9. In this respect, the active connection between the end of the bar 8 and the limiting element 9 is preferably implemented by a snap-in connection.

In the variant shown in FIG. 12, the terminating element 81 is frustoconical. This embodiment is in particular suitable for the first preferred embodiment of the limiting element 9 as a tilt limitation 91. The limiting element 9 then has a region designed as a claw 98 and having a central inlet opening 982 that is dimensioned such that the diameter of the inlet opening 982 is larger than the diameter D of the bar 8, but is smaller than the maximum diameter of the frustoconical terminating element 81. The claw 98 forms a conical surface 981 around the inlet opening 982 through which the terminating element 81 can be introduced into the limiting element 9. A cavity 99 is provided beneath the claw 98 and is designed such that the terminating element 81 can move contactlessly in the cavity 99 as long as the tilt of the rotor 3 does not exceed the predefinable limit value that is given by the capacity of the passively magnetic stabilization of the rotor 3. If this limit value is exceeded, the terminating element 81 comes into physical contact with the limiting element 9 and thus prevents a further increase in the tilt of the rotor 3. It is advantageous in this respect that the frustoconical terminating element 81 can roll off at the inner surface of the limiting element 9.

The variant shown in FIG. 13 shows an embodiment in which the terminating element 81 is designed as a spherical head. In the first embodiment of the limiting element 9 as a tilt limitation 91, the diameter of the spherical head 81 is dimensioned such that the spherical head 81 is received free of contact in the cavity 99 after its introduction into the claw 98 as long as the rotor 3 is not tilted or is oriented in a tilt that can be compensated by the passively magnetic support. The spherical head 81 only contacts the inner wall of the cavity 99, rolls off thereon and thus limits the maximum possible tilt of the rotor 3 when the tilt of the rotor 3 becomes too strong or too large. The tilt of the root 3 is indicated by the double arrow without a reference numeral in FIG. 13.

If the variant shown in FIG. 13 in accordance with the second preferred configuration of the limiting element 9 is configured as a mechanical bearing 92, the diameter of the spherical head 81 is dimensioned such that the spherical head 81 constantly contacts the wall of the cavity—that is also with a non-tilted rotor 3—after its introduction into the cavity 99 and thus cooperates with this wall in the form of a slide bearing.

The limiting element 9 that is preferably of stable shape can—as shown in FIG. 13—be connected to the mixing tank 2 by welding or adhesive bonding and can be fixed with respect thereto.

The variants shown in FIGS. 12 and 13 in particular provide the additional advantage that the displacement of the rotor 3 in the axial direction A is also limited by this design, and indeed both for upward displacements of the rotor 3 in the axial direction A and for downward displacements of the rotor 3 in the axial direction A.

Figure 14:
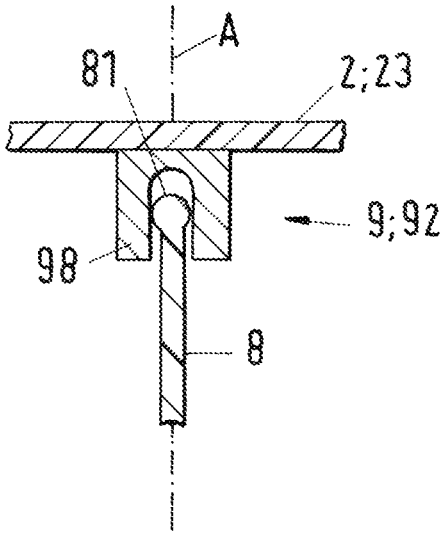

FIG. 14 shows a variant that is in particular suitable for the second preferred configuration of the limiting element 9 as a mechanical bearing 92. This variant accordingly corresponds approximately to that shown in FIG. 13, wherein FIG. 14 specifically shows an embodiment as a slide bearing of plastic in which the terminating element 81 configured as a spherical head snaps into the claw 98 such that the axial clearance of the bar 8 is likewise restricted.

The invention claimed is:

1. A single-use apparatus for a mixing apparatus, the mixing apparatus including a reusable apparatus configured for multiple use, and including a stator and a support tank, the stator including a stator housing with a separating can, the single-use apparatus comprising:

a plastic flexible mixing tank configured to receive substances to be mixed or stirred, the mixing tank including a cylindrical bucket at a base thereof;

a rotor arranged in the cylindrical bucket of the mixing tank and including at least one vane configured to mix and stir the substances, the vane configured to be driven to rotate about an axial direction;

a bar extending in the axial direction and being rotationally fixedly connected to the rotor in an operating state; and a limiting element fixed with respect to the mixing tank and configured to cooperate with the bar, the limiting element having an inner diameter that is larger than a diameter of the bar, such that there is a clearance between an inner wall of the limiting element and the bar, the limiting element being configured and arranged such that the bar is capable of rotating with respect to the limiting element in the operating state and a tilt of the rotor is at least limited by physical contact between the bar and the limiting element, the single-use apparatus being configured for single use and configured to cooperate with the reusable apparatus by being insertable into the support tank of the reusable apparatus such that the rotor or the bucket is disposed in the separating can, and the rotor being surrounded by the stator outside of the bucket and such that at least a part of the stator is coplanar with a part of the rotor, and drivable about the axial direction by the stator of the reusable apparatus contactlessly through a magnetic rotationally field and being completely radially and longitudinally contactlessly magnetically supportable with respect to the stator.

2. A mixing apparatus for mixing or stirring substances, comprising:

a mixing tank for receiving the substances to be mixed or to be stirred, and including a cylindrical bucket at a base thereof;

a rotor arranged in the mixing tank, and including at least one vane configured to mix and stir the substances, the vane configured to be driven to rotate about an axial direction;

a stator comprising a stator housing including a separating can in which the rotor or the bucket is capable of being inserted, the stator being arranged outside of the cylindrical bucket of the mixing tank and surrounding the rotor such that at least a part of the stator is coplanar with a part of the rotor, and configured to contactlessly magnetically drive the rotor to rotate about the axial direction in an operating state, and to completely radially and longitudinally contactlessly magnetically support the rotor with respect to the stator;

a bar extending in the axial direction and rotationally fixed to the rotor; and a mechanical limiting element fixed with respect to the mixing tank and being configured to cooperate with the bar, the limiting element being configured and arranged such that the bar is capable of rotating with respect to the limiting element and a tilt of the rotor being at least limited by a physical contact between the bar and the limiting element.

3. The mixing apparatus in accordance with claim 2, wherein the stator is a bearing and drive stator configured to contactlessly magnetically drive the rotor in the operating state and contactlessly magnetically support the rotor at least radially with respect to the stator.

4. The mixing apparatus in accordance with claim 3, wherein the rotor is passively magnetically stabilized with respect to the axial direction.

5. The mixing apparatus in accordance with claim 3, wherein the rotor is passively magnetically stabilized against tilting with respect to the axial direction.

6. The mixing apparatus in accordance with claim 2, wherein the limiting element is a tilt limitation such that the bar rotates free of contact with respect to the tilt limitation with a non-tilted rotor in the operating state and such that a tilt of the rotor is limited by a physical contact between the bar and the tilt limitation.

7. The mixing apparatus in accordance with claim 2, wherein the limiting element is a mechanical bearing for the bar.

8. The mixing apparatus in accordance with claim 7, wherein the mechanical bearing is a rolling bearing, a slide bearing, a fluid-lubricated bearing or a hydrodynamic bearing.

9. The mixing apparatus in accordance with claim 7, wherein the mechanical bearing is a pendulum bearing configured to take up tilts of the bar.

10. The mixing apparatus in accordance with claim 2, wherein the limiting element is arranged inwardly at one of two axial limiting surfaces of the mixing tank.

11. The mixing apparatus in accordance with claim 2, wherein the bar is secured against a separation from the limiting element.

12. The mixing apparatus in accordance with claim 2, wherein the bar extends through the limiting element in the axial direction.

13. The mixing apparatus in accordance with claim 2, wherein the bar has an end remote from the rotor and a terminating element configured to be received by the limiting element at the end remote from the rotor.

14. The mixing apparatus in accordance with claim 13, wherein the terminating element is capable of being introduced into the limiting element via a snap-in connection.

15. The mixing apparatus in accordance with claim 2, wherein the at least one vane includes a plurality of vanes provided at the bar.

16. The mixing apparatus in accordance with claim 2 further comprising a single-use apparatus configured for single use; and a reusable apparatus configured for multiple use, the single-use apparatus comprising the mixing tank, the rotor, the at least one vane, the bar, and the limiting element, the mixing tank being a plastic flexible mixing tank, and the reusable apparatus comprising the stator and a support tank configured to receive the mixing tank.

17. The mixing apparatus in accordance with claim 2, wherein the limiting element is a mechanical radial bearing for the bar.

* * * * *